US012571585B2

(12) United States Patent
Gaskin et al.

(10) Patent No.: US 12,571,585 B2
(45) Date of Patent: Mar. 10, 2026

(54) PROCESS AND APPARATUS FOR HEAVY HYDROCARBON REMOVAL FROM LEAN NATURAL GAS BEFORE LIQUEFACTION

(71) Applicant: Lummus Technology Inc., Bloomfield, NJ (US)

(72) Inventors: Thomas K. Gaskin, Spring, TX (US); Fereidoun Yamin, Houston, TX (US); Sanjiv N. Patel, Sugar Land, TX (US); Catherine L. Balko, Hoboken, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 438 days.

(21) Appl. No.: 17/729,192

(22) Filed: Apr. 26, 2022

(65) Prior Publication Data

US 2022/0252343 A1 Aug. 11, 2022

Related U.S. Application Data

(63) Continuation of application No. 15/127,304, filed as application No. PCT/US2015/020360 on Mar. 13, 2015, now abandoned.

(Continued)

(51) Int. Cl.
*F25J 3/02* (2006.01)

(52) U.S. Cl.
CPC ..... *F25J 3/0295* (2013.01); *F25J 3/0209* (2013.01); *F25J 3/0233* (2013.01); *F25J 3/0238* (2013.01); *F25J 3/0242* (2013.01)

(58) Field of Classification Search
CPC ..... F25J 3/0233; F25J 3/0209; F25J 3/061; F25J 3/0635; F25J 3/064; F25J 3/0295;
(Continued)

(56) References Cited

U.S. PATENT DOCUMENTS 3,542,673 A 11/1970 Ringler
3,568,458 A 3/1971 Hoffman
(Continued)

FOREIGN PATENT DOCUMENTS

CN 101072848 A 11/2007
CN 101290184 A 10/2008
(Continued)

OTHER PUBLICATIONS

Examination Report from BH Application No. 20160121 dated Aug. 25, 2022.

(Continued)

*Primary Examiner* — Tavia Sullens
(74) *Attorney, Agent, or Firm* — Calfee, Halter & Griswold LLP

(57) ABSTRACT

A process is described herein for removing high freeze point hydrocarbons, including benzene compounds, from a mixed feed gas stream. The process involves cooling process streams in one or more heat exchangers and separating condensed compounds in multiple separators to form a methane-rich product gas stream. Select solvent streams from a fractionation train and/or separate solvent streams are employed to lower the freeze point of one or more streams that contain high freeze point hydrocarbons. A corresponding system also is disclosed.

16 Claims, 4 Drawing Sheets

Related U.S. Application Data

(60) Provisional application No. 61/953,355, filed on Mar. 14, 2014.

(58) Field of Classification Search
CPC ..... F25J 3/0695; F25J 3/0238; F25J 3/0242; F25J 3/0247
USPC ..... 62/620, 621
See application file for complete search history.

(56) References Cited

U.S. PATENT DOCUMENTS

| | | | | |
|---|---|---|---|---|
| 3,622,504 | A | 11/1971 | Strum | |
| 3,656,311 | A | 4/1972 | Kaiser | |
| 3,815,376 | A | 6/1974 | Lofredo et al. | |
| 4,019,964 | A | 4/1977 | Fickel | |
| 4,061,481 | A * | 12/1977 | Campbell | F25J 3/0233 62/621 |
| 4,272,270 | A | 6/1981 | Higgins | |
| 4,436,540 | A | 3/1984 | Dowd et al. | |
| 4,689,063 | A | 8/1987 | Paradowski et al. | |
| 4,698,081 | A | 10/1987 | Aghili | |
| 4,854,955 | A | 8/1989 | Campbell et al. | |
| 4,895,584 | A * | 1/1990 | Buck | F25J 3/0233 62/621 |
| 5,325,673 | A | 7/1994 | Durr et al. | |
| 5,685,170 | A | 11/1997 | Sorensen | |
| 5,724,833 | A | 3/1998 | Devers | |
| 5,737,940 | A | 4/1998 | Yao et al. | |
| 5,799,507 | A | 9/1998 | Wilkinson et al. | |
| 5,881,569 | A | 3/1999 | Campbell et al. | |
| 5,890,378 | A | 4/1999 | Rambo et al. | |
| 6,116,050 | A | 9/2000 | Yao et al. | |
| 6,401,486 | B1 | 6/2002 | Lee et al. | |
| 6,425,266 | B1 | 7/2002 | Roberts | |
| 6,662,589 | B1 | 12/2003 | Roberts et al. | |
| 6,837,070 | B2 | 1/2005 | Mak | |
| 7,051,552 | B2 * | 5/2006 | Mak | F25J 3/0238 62/621 |
| 7,051,553 | B2 | 5/2006 | Mak et al. | |
| 7,210,311 | B2 | 5/2007 | Wilkinson et al. | |
| 7,219,513 | B1 | 5/2007 | Mostafa | |
| 7,237,407 | B2 | 7/2007 | Paradowski | |
| 8,209,997 | B2 | 7/2012 | Malsam | |
| 8,413,463 | B2 | 4/2013 | Malsam | |
| 8,627,681 | B2 | 1/2014 | Malsam | |
| 9,291,387 | B2 | 3/2016 | Malsam | |
| 9,316,433 | B2 | 4/2016 | Mak | |
| 2002/0112993 | A1 | 8/2002 | Puglisi | |
| 2003/0106334 | A1 | 6/2003 | Gaskin | |
| 2004/0159122 | A1 | 8/2004 | Patel et al. | |
| 2004/0244415 | A1 | 12/2004 | Paradowski | |
| 2005/0086976 | A1 | 4/2005 | Eaton | |
| 2006/0144081 | A1 | 7/2006 | Paradowski | |
| 2006/0150672 | A1 | 7/2006 | Lee et al. | |
| 2006/0260355 | A1 | 11/2006 | Roberts et al. | |
| 2007/0157663 | A1 | 7/2007 | Mak et al. | |
| 2007/0240450 | A1 | 10/2007 | Mak | |
| 2008/0000216 | A1 | 1/2008 | Fujimura et al. | |
| 2008/0000265 | A1 | 1/2008 | Cuellar et al. | |
| 2008/0115532 | A1 | 5/2008 | Jager | |
| 2008/0271480 | A1 | 11/2008 | Mak | |
| 2010/0011663 | A1 | 1/2010 | Coyle | |
| 2010/0223950 | A1 | 9/2010 | Malsam | |
| 2010/0263532 | A1 | 10/2010 | Thomas et al. | |
| 2011/0067441 | A1 | 3/2011 | Martinez et al. | |
| 2012/0047943 | A1 | 3/2012 | Barclay et al. | |
| 2013/0219957 | A1 | 8/2013 | Malsam | |
| 2014/0060114 | A1 * | 3/2014 | Mak | F25J 3/0233 62/620 |
| 2014/0075987 | A1 | 3/2014 | Mak | |
| 2014/0260420 | A1 | 9/2014 | Mak | |
| 2016/0069610 | A1 | 3/2016 | Anguiano et al. | |
| 2016/0245587 | A1 | 8/2016 | Shah | |

FOREIGN PATENT DOCUMENTS

| | | | | |
|---|---|---|---|---|
| CN | 101824344 | A | 9/2010 | |
| CN | 102027303 | A | 4/2011 | |
| GB | 800888 | A | 9/1958 | |
| JP | S56-124401 | A | 9/1981 | |
| JP | 2005042093 | A | 2/2005 | |
| JP | 2006510867 | A | 3/2006 | |
| JP | 2008523186 | A | 7/2008 | |
| JP | 2009174849 | A | 8/2009 | |
| JP | 2010202875 | A | 9/2010 | |
| JP | 2011521052 | A | 7/2011 | |
| JP | 2013505421 | A | 2/2013 | |
| JP | 2015531851 | A | 11/2015 | |
| KR | 1020120069729 | A | 6/2012 | |
| KR | 1020150102931 | A | 9/2015 | |
| WO | B002192 | A1 | 10/1980 | |
| WO | WO-8002192 | A * | 10/1980 | C01B 3/506 |
| WO | 9736139 | A1 | 10/1997 | |
| WO | 0188447 | A1 | 11/2001 | |
| WO | 02061354 | A1 | 8/2002 | |
| WO | 2004057253 A23 | | 7/2004 | |
| WO | 2009140070 | A1 | 11/2009 | |
| WO | 2012052411 | A1 | 4/2012 | |
| WO | 2014022510 | A2 | 2/2014 | |
| WO | 2015138846 | A1 | 9/2015 | |

OTHER PUBLICATIONS

Office Action from MX Application No. MX/a/2016/011957 dated Nov. 4, 2022.
Examination Report from BH Application No. 20160121 dated Jan. 16, 2022.
Office Action from BR Application No. BR112016021197-9 dated Jan. 14, 2022.
The First Office Action from the State Intellectual Property Office of the People's Republic of China for Chinese Patent Application No. 201580025053.1, dated Jul. 25, 2018.
The Second Office Action from the State Intellectual Property Office of the People's Republic of China for Chinese Patent Application No. 201580025053.1, dated Mar. 20, 2019.
The Office Action from the Egyptian Patent Office for Egypt Patent Application No. 1530/2016 dated Sep. 30, 2018.
Supplemental European Search Report dated Mar. 16, 2018 in corresponding European Patent Application No. 15760874.6.
Communication from EP Application No. 15760874.6 dated Dec. 23, 2021.
Office Action from the Japanese Patent Office for Japanese Application No. JP2016575628 dated Feb. 5, 2019.
Office Action from MX Application No. MX/a/2016/011957 dated Mar. 3, 2022.
The Office Action from the Omani Patent Office for Oman Patent Application No. OM/P/2016/00267 dated Jul. 19, 2018.
Office Action from the Kingdom of Saudi Arabia for Saudi Arabian Patent Application No. SA516371855 dated Mar. 8, 2020.
Office Action from U.S. Appl. No. 15/127,304 dated Apr. 5, 2019.
Office Action from U.S. Appl. No. 15/127,304 dated Nov. 29, 2019.
Office Action from U.S. Appl. No. 15/127,304 dated Apr. 2, 2020.
Office Action from U.S. Appl. No. 15/127,304 dated Oct. 16, 2020.
Office Action from U.S. Appl. No. 15/127,304 dated Mar. 18, 2021.
Office Action from U.S. Appl. No. 15/127,304 dated Jan. 27, 2022.
Huang S. et al., "Handling LPG Components in LNG Plants", 2011 Aiche Spring Meeting & 7th Global Congress on Process Safety; Hyatt Regency Chicago, Chicago, IL, Mar. 13-17, 2011, New York; American Institute of Chemical Engineers, US, (Mar. 1, 2011), ISBN 978-0-8169-1067-0.
Production of Benzene, Toluene, and Xylenes from Natural Gas via Methanol: Process Synthesis and Global Optimization: DOI 10.1002/aic.15144; Published online Jan. 13, 2016 in Wiley Online Library (wileyonlinelibrary.com).
Office Action from MX Application No. MX/a/2016/011957 dated Apr. 26, 2023.

(56) References Cited

OTHER PUBLICATIONS

Communication from EP Application No. 15760874.6 dated Feb. 28, 2025.

* cited by examiner

PROCESS AND APPARATUS FOR HEAVY HYDROCARBON REMOVAL FROM LEAN NATURAL GAS BEFORE LIQUEFACTION

RELATED APPLICATIONS

This application is a continuation of U.S. patent application Ser. No. 15/127,304, filed Sep. 19, 2016, which is the U.S. national stage entry of PCT/US2015/020360, filed Mar. 13, 2015, which claims priority to and the benefit of U.S. Provisional Patent Application No. 61/953,355, filed Mar. 14, 2014, the entire disclosures of which are incorporated by reference herein.

BACKGROUND

Removal of high freeze point components is required to avoid freezing in natural gas liquefaction plants. An exemplary specification for feed gas to a liquefaction plant contains less than 1 parts per million by volume (ppmv) benzene, and less than 0.05% molar pentane and heavier (C5+) components. High freeze point hydrocarbon component removal facilities are typically located downstream of pretreatment facilities to remove mercury, acid gases such as CO2 and H2S, and water.

A simple and common system for pretreatment of LNG feed gas for removal of high freeze point hydrocarbons involves use of an inlet gas cooler, a first separator for removal of condensed liquids, an expander (or Joule-Thompson valve or refrigeration apparatus) to further cool the vapor from the first separator, a second separator for removal of additional condensed liquid, and a reheater for heating the cold vapor from the second separator. The reheater and the inlet gas cooler would typically constitute a single heat exchanger. The liquid streams from the first and second separators would contain the benzene and C5+ components of the feed gas, along with a portion of lighter hydrocarbons in the feed gas which have also condensed. These liquid streams may be reheated by heat exchange with the inlet gas. These liquid streams may also be further separated to concentrate the high freeze point components from components that may be routed to the LNG plant without freezing.

Feed gas composition sent to an existing LNG facility may change over time. Liquid recovery plants may be installed on pipelines upstream of the LNG facility for removal of C5+ condensate for feed to a refinery or removal of propane and butane for local heating demand or chemical plant feedstock. Additional gas fields may come on-line, or the mix of gases from various fields may change. A variety of circumstances can lead to LNG facility feed gas containing a higher concentration of benzene.

In cases in which a feed gas to an existing LNG plant changes to contain more benzene than was anticipated, the high freeze point hydrocarbon removal plant will not be able to meet the required benzene removal to avoid freezing in the liquefaction plant. Additionally, specific locations in the high freeze point component removal plant may freeze due to the increase in benzene. The LNG facility may have to reduce production by no longer accepting a source of gas with higher benzene concentration, or cease production entirely if the benzene concentration cannot be reduced. It would be useful to develop a process and system that overcomes these problems.

SUMMARY

A first embodiment described herein comprises a process for removing high freeze point hydrocarbons, including benzene compounds, from a mixed feed gas stream. The process comprises cooling the mixed feed gas stream in a first heat exchanger to condense at least a portion of the C3, C4 and C5 components and high freeze point hydrocarbons, separating the condensed C3, C4, C5 components and high freeze point hydrocarbons in a first separator to form a first liquid stream and a first gas stream, cooling the first gas stream in a second heat exchanger to condense at least a portion of the first gas stream, and separating the condensed portion of the first gas stream in a second separator to form a methane-rich second gas stream as a top stream and a second liquid stream. The first and second liquid streams are then fed to a first fractionator, and methane gas is removed in a top stream and a third liquid stream is removed as a bottom stream. The process further comprises removing a methane-rich product gas stream downstream from the top of the second separator, fractionating the third liquid stream in a fractionation train to obtain a recycle stream comprising at least one of C3 and components and C4 components, and a high freeze point hydrocarbon stream, and feeding the recycle stream comprising at least one of C3 components and C4 components to the process at a location upstream from the first fractionator to lower the freeze point of the stream at the location where the recycle stream is introduced.

Another embodiment is a process for removing high freeze point hydrocarbons, including benzene compounds, from a mixed feed gas stream, comprising cooling the mixed feed gas stream in a first heat exchanger to condense at least a portion of the C3, C4 and C5 components and high freeze point hydrocarbons, separating the condensed C3, C4, C5 components and high freeze point hydrocarbons in a first separator to form a first liquid stream and a first gas stream, cooling the first gas stream in a second heat exchanger to condense at least a portion of the first gas stream, and separating the condensed portion of the first gas stream in a second separator to form a methane-rich second gas stream as a top stream and a second liquid stream. The process also includes feeding the first and second liquid streams to a first fractionator, and removing methane gas in a top stream and to remove a third liquid stream as a bottom stream, removing a methane-rich product gas stream downstream from the top of the second separator, fractionating the third liquid stream in a fractionation train to obtain hydrocarbon product streams, and feeding a solvent stream comprising at least one of C3 components and C4 components to the process at a location upstream from the first fractionator to lower the freeze point of the stream at the location where the solvent stream is introduced, thereby enabling lower process temperatures to be used.

A further embodiment is a system for pre-treatment of a mixed feed gas stream containing methane and benzene components to remove the benzene components, the system comprising a first heat exchanger for partially condensing the mixed feed gas, a first separator configured to separate the mixed feed gas to form a first liquid hydrocarbon stream containing C3+ components from a first methane-containing gas stream, a second heat exchanger configured to at least partially condense the first methane-rich gas stream, a second separator configured to separate a second methane-containing gas stream from a second liquid hydrocarbon stream, a fractionator configured to remove methane from the first liquid hydrocarbon stream and the second liquid hydrocarbon stream, and a solvent inlet configured to feed a solvent stream comprising at least one of C3 components and C4 components to the system. The solvent inlet is positioned upstream from the first or second separator, or downstream from the second separator and upstream from the fractionator.

Yet another embodiment is a process for removing high freeze point hydrocarbons, including benzene compounds, from a mixed hydrocarbon feed gas stream, comprising cooling the mixed feed gas stream in a first heat exchanger to condense at least a portion of the C3, C4 and C5 components and high freeze point hydrocarbons, separating the condensed C3, C4, C5 components and high freeze point hydrocarbons in a first separator to form a first liquid stream and a first gas stream, partially condensing the first gas stream by cooling the first gas stream in a second heat exchanger or reducing the pressure of the first gas stream, and separating the condensed portion of the first gas stream in a second separator to form a methane-rich second gas stream, and a second liquid stream. The process also includes removing a methane-rich product gas stream downstream from the top of the second separator, feeding the first liquid stream to a fractionation train and fractionating the first liquid stream to obtain hydrocarbon product streams and a high freeze point hydrocarbon stream comprising benzene components, and withdrawing at least a portion of the second liquid stream, increasing the pressure of the withdrawn portion, and recycling at least some of the withdrawn and compressed portion to the process to a location upstream from, or at, the first separator to prevent freezing of process streams and process components.

A further embodiment is a system for pre-treatment of a mixed feed gas stream containing methane and benzene components to remove the benzene components, the system comprising a first heat exchanger for cooling and partially condensing the mixed feed gas, a first separator configured to separate the cooled and partially condensed mixed feed gas stream to form a first liquid hydrocarbon stream containing C3+ components and a first methane-containing gas stream, an expander configured to expand and partially condense the first methane-containing gas stream, a second separator configured to separate the first methane-containing gas stream to form a second methane-containing gas stream and a second liquid hydrocarbon stream, a pressure-increasing device configured to increase the pressure of at least one of the first liquid hydrocarbon stream and the second liquid hydrocarbon stream, and a recycle inlet configured to feed a recycled portion of at least one of the first liquid hydrocarbon stream and the second liquid hydrocarbon stream back into the system at a location upstream from, or at, the first separator.

DETAILED DESCRIPTION

Figure 1:
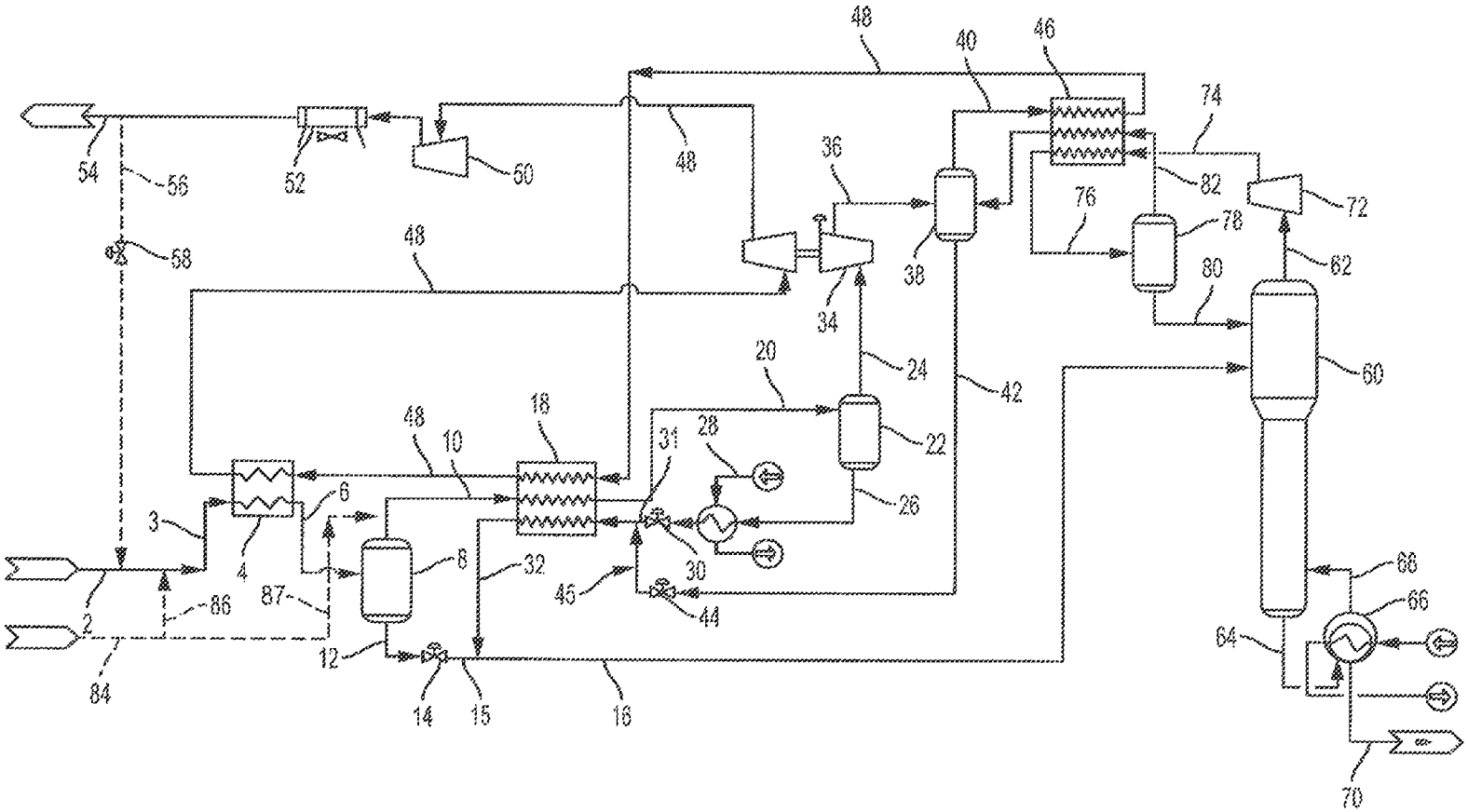
FIG. 1 schematically depicts a system and process for extracting high freeze point hydrocarbons from a mixed hydrocarbon gas stream according to a first embodiment.

New cryogenic processes are described herein to extract freezing components (heavy hydrocarbons, including but not necessarily limited to benzene, toluene, ethylbenzene and xylene (BTEX)) from a pretreated natural gas stream prior to liquefaction.

Raw feed gas is first treated to remove freezing components such as CO2, water and heavy hydrocarbons before liquefaction. Removal of CO2 and water is achieved by several commercially available processes. However, removal of freezing hydrocarbon components by cryogenic process depends on the type and amount of components to be removed. For feed gases that are low in components such as C2, C3, C4s, but contain hydrocarbons that will freeze during liquefaction, separation of the freezing components is more difficult.

Table 3 below shows a typical gas composition that could be used for liquefaction. The gas is very lean, but has a significant amount of heavy freezing components. Separation of the freezing components is difficult because during the cooling process, there isn't a sufficient amount of C2, C3 or C4 in the liquid stream to dilute the concentration of freezing components and keep them from freezing. This problem is greatly magnified during the startup of the process when the first components to condense from the gas are heavy ends, without the presence of any C2 to C4 components. In order to overcome this problem, processes and systems have been developed that will eliminate freezing problems during startup and normal operation.

Definitions

As used herein, the term "high freeze point hydrocarbons" refers to benzene, toluene, ethylbenzene, xylene, and other compounds, including most hydrocarbons with at least six carbon atoms. As used herein, the term "benzene compounds" refers to benzene, and also to toluene, ethylbenzene, xylene, and/or other substituted benzene compounds. As used herein, the term "methane-rich gas stream" means a gas stream with greater than 50 volume % methane. As used herein, the term "pressure increasing device" refers to a component that increases the pressure of a gas or liquid stream, including a compressor and/or a pump.

Table 1 below shows the freeze point of select hydrocarbons.

TABLE 1

| Component | Boiling point at 14.7 psia, ° F. | Vapor pressure at 100° F., psia | Freezing Point at 14.4 psia, ° F. |
|---|---|---|---|
| Propane | −44 | 118 | −305 |
| N-Butane | 31 | 51 | −217 |
| N-Pentane | 97 | 16 | −201 |
| N-Hexane | 156 | 5 | −140 |
| N-Heptane | 206 | 2 | −131 |
| N-Octane | 258 | 1 | −70 |
| Benzene | 176 | 3 | 42 |
| P-Xylene | 281 | 0.3 | 56 |
| O-Xylene | 292 | 0.3 | −13 |

(Physical property data on Table 2 is from the Gas Processors Suppliers Association Engineering Data Book)

Referring to Table 1, benzene has a boiling point and vapor pressure similar to n-hexane and n-heptane, However, the freeze point of benzene is about 175° F. higher. N-octane, P-xylene, and 0-xylene, among others, also have physical properties that lead to freezing at temperatures above, where other components common in natural gas would not have substantially condensed as liquid.

In embodiments, the processes described herein typically have mixed hydrocarbon feed streams with a high freeze point hydrocarbon content in the range of 100 to 20,000 ppm molar, or 10 to 500 ppm molar, a methane content in the range of 80 to 98% molar, or 90 to 98% molar. The methane-rich product stream typically has a high freeze point hydrocarbon content in the range of 0 to 500 ppm molar C5+, or 0 to 1 ppm benzene molar, and a methane content in the range of 85 to 98% molar, or 95 to 98% molar.

In embodiments, the processes described herein typically utilize temperatures and pressures in the range of 10 to −50 F and 400 to 1000 psia in the first separator, and −10 to −150 F and 400 to 1000 psia in the second separator. If a third separator is used, the temperatures and pressures typically are in the range of −50 to −170 F and 300 to 700 psia.

A typical specification for inlet gas to a liquefaction plant is <1 ppm molar benzene and <500 ppm molar pentane and heavier components.

First Embodiment

Referring first to FIG. 1, a partial C2+ recovery process is shown. The process uses heat exchangers and phase separators to remove components of the mixed feed gas that will not be part of the natural gas product. Initially, the cooling curve of the feed gas can be analyzed to determine the freeze point of the mixture. A non-freezing solvent such as propane or butane is then added in a sufficient quantity to keep the heavy freezing components in liquid phase. The liquid produced during the separation of the natural gas product is sent to a demethanizer column. The solvent injection can be carried out at one or more locations in the cooling train, optionally using different amounts of solvent depending upon the composition of the feed gas and the location at which the recycle stream is introduced.

The process that includes sending the liquid from the separators to the demethanizer (by preheating) involves pressure drops across control valves. These reductions in pressure can lead to flashing, cooling, and possibly to freezing conditions within the process lines. To prevent freezing, solvent may be added just upstream of the control valve, or at another suitable location. Freezing of hydrocarbons may also be prevented by preheating the separator liquid prior to pressure let down. The selection of solvent addition and/or level of preheating will depend on the amount and type of freezing component.

Figure 2:
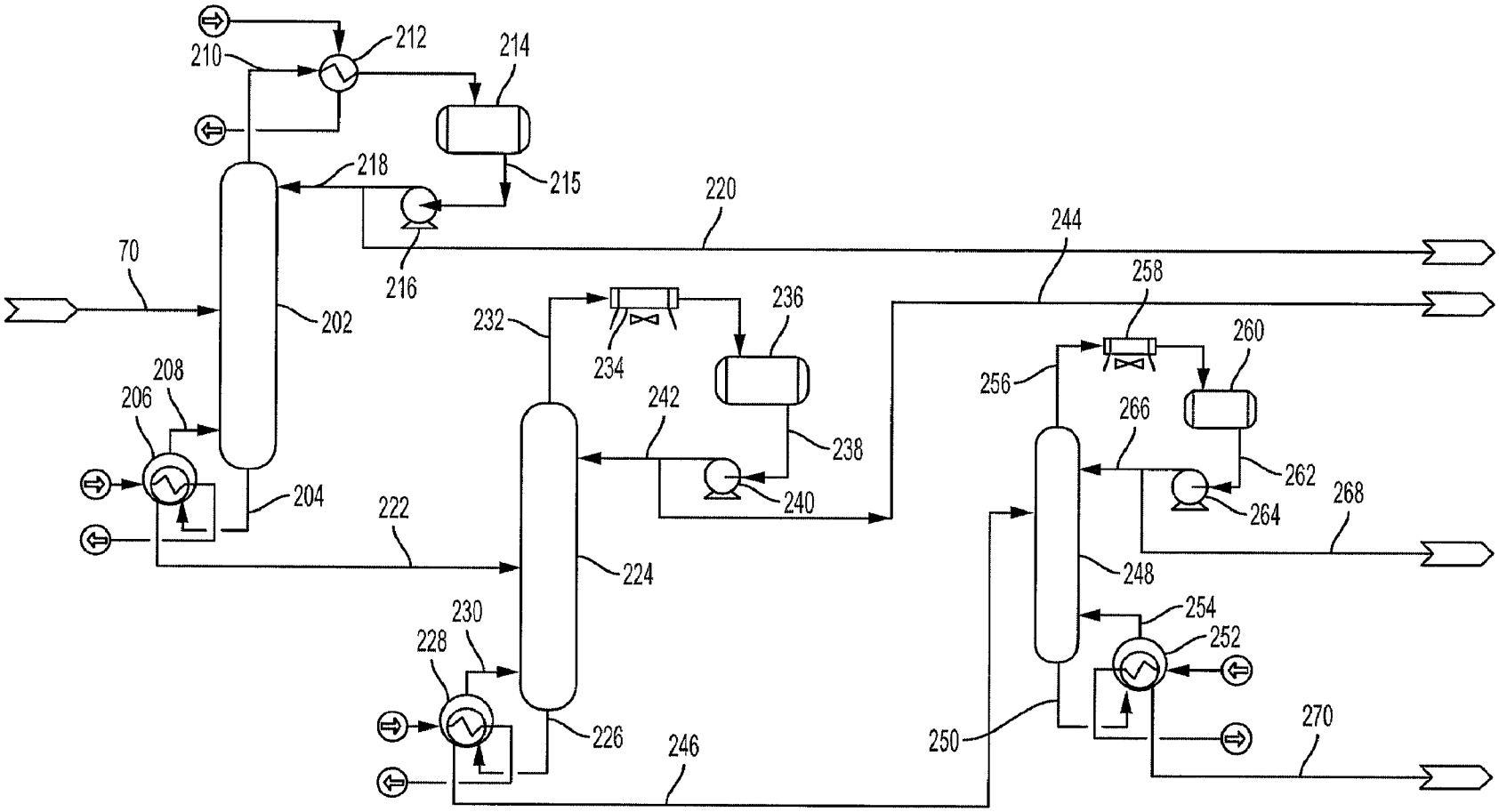
FIG. 2 schematically depicts a system and process for fractionating a mixed hydrocarbon stream obtained from the process shown in FIG. 1.

The demethanizer tower removes methane and lighter components at the top, and recovers a portion of the C2+ components at the bottom. The C2+ stream from the bottom of the tower is sent to a fractionation train win which C2, C3, C4 and C5+ components are separated. A part of the C3 and/or C4 stream(s) is recycled back to the cryogenic plant for freeze protection. FIG. 2 shows an embodiment of a fractionation train which includes deethanizer, depropanizer and debutanizer towers. One, two or three different solvents can be recycled to the gas purification system, provided that the solvent is substantially free of freezing components. In embodiments, the solvent comprises C3 and C4 components. In some cases, C2 components are used or also included in a mixed hydrocarbon solvent recycle stream.

An added advantage of the process described herein is that the solvent used to prevent freezing, such as propane or butane, can be recovered from the feed gas. The process can be operated such that all solvent added is recovered and in this case no continuous external makeup is required. If the plant is required to recover additional C2, C3 or C4 that is present in the feed, the process can run under conditions that are suitable to produce saleable C2, C3 and/or C4 products.

Table 2 shows two sets of data at select points in the process where freezing might occur. The data set labeled "With Solvent" shows injection of propane solvent, and a 10 deg. C. approach to freeze point. The data set labeled "Without Solvent" is the same process, but without propane solvent injection. This data set shows −23 deg. C. to freeze, making the process infeasible. Table 3 provides a material balance for normal operation that shows feed and products from the process.

During startup of the system shown in FIG. 1, the product gas stream still contains benzene and heavier components, and needs to be flared as it does not meet liquefaction feed specifications. However, instead of flaring all the product gas until it is on specification, a part of the product gas during start-up can be recycled back into the front end of the liquefaction process, thereby reducing flaring. In addition, the recycle gas is lower in freezing components than the feed, and tends to dilute the feed to the cryogenic plant thereby helping to protect against freezing during the cool down process. Recycle also accelerates initial cool-down of the plant as more gas will pass through the plant pressure reduction devices. Product gas is also referred to as residue gas in the Tables.

Table 4 shows conditions during startup with both residue gas recycle and solvent injection. The steps shown are for a typical startup and are listed below:

1. Begin Cooling Inlet Gas, liquid starts forming in separators. Expander bypassed, gas through JT valve. Demethanizer overhead flared.
2. Residue recycle started
3. Fresh propane added. Residue recycle increased.
4. Continue to cool plant.
5. Expander on.
6. DeMethanizer overhead to residue. Fractionation train on. Depropanizer overhead recycled back to inlet, start decreasing fresh propane.
7. Continue cooling plant, decreasing fresh propane.
8. Continue cooling plant, decreasing fresh propane.
9. All solvent injection from fractionation train.
10. Decrease residue recycle.
11. No residue recycle. Decrease amount of solvent.

During the initial stages, fresh propane from storage is used to prevent freezing. However, once propane is being produced in the system, injection of fresh propane from storage is ramped down. Table 4 also shows that during step 2 residue recycle is started, and continues till step 10.

Table 5 shows conditions during startup without residue gas recycle or solvent injection. The table shows that starting from step 4 freezing takes place, and that startup is not possible for this process.

TABLE 2

Freezing Suppression

| STREAM NAME (Ref. No. in FIG. 1) | | With Solvent Solvent (84) | With Solvent Warm Separator Liquids (15) | With Solvent Cold Separator Liquids (31) | With Solvent Expander Separator Liquids (45) | Without Solvent (Control) Solvent (84) | Without Solvent (Control) Warm Separator Liquids (15) | Without Solvent (Control) Cold Separator Liquids (31) | Without Solvent (Control) Expander Separator Liquids (45) |
|---|---|---|---|---|---|---|---|---|---|
| TEMPERATURE | F. | 132 | −2 | −93 | −124 | | −20 | −117 | −125 |
| PRESSURE | Psia | 856 | 475 | 480 | 480 | | 475 | 480 | 480 |
| MASS FLOW RATE | lb/hr | 24,191 | 22,352 | 71,255 | 196,347 | 0 | 20,940 | 24,351 | 188,161 |
| DEGREES TO FREEZE | C. | | 10 | 10 | 48 | | 8 | −23 | 40 |
| COMPOSITON | Mole % | | | | | | | | |
| Helium | | 0.00% | 0.00% | 0.01% | 0.00% | | 0.00% | 0.00% | 0.00% |
| CO2 | | 0.00% | 0.01% | 0.01% | 0.01% | | 0.01% | 0.01% | 0.01% |
| H2S | | 0.00% | 0.00% | 0.00% | 0.00% | | 0.00% | 0.00% | 0.00% |
| Nitrogen | | 0.00% | 0.01% | 0.06% | 0.05% | | 0.01% | 0.04% | 0.05% |
| Methane | | 0.00% | 29.53% | 79.61% | 86.16% | | 29.00% | 72.49% | 87.71% |
| Ethane | | 0.35% | 2.98% | 5.26% | 7.94% | | 2.96% | 6.43% | 8.26% |
| Propane | | 99.55% | 8.74% | 9.90% | 5.13% | | 3.88% | 7.11% | 2.86% |
| i-Butane | | 0.10% | 1.98% | 1.33% | 0.33% | | 2.00% | 2.73% | 0.49% |
| n-Butane | | 0.00% | 2.88% | 1.46% | 0.27% | | 2.95% | 3.38% | 0.42% |
| i-Pentane | | 0.00% | 1.81% | 0.47% | 0.04% | | 1.89% | 1.33% | 0.07% |
| n-Pentane | | 0.00% | 2.30% | 0.45% | 0.03% | | 2.41% | 1.37% | 0.05% |
| n-Hexane | | 0.00% | 4.42% | 0.28% | 0.01% | | 4.78% | 0.99% | 0.01% |
| Methylcyclopentane | | 0.00% | 3.14% | 0.17% | 0.00% | | 3.42% | 0.59% | 0.01% |
| Benzene | | 0.00% | 9.99% | 0.44% | 0.01% | | 10.99% | 1.51% | 0.02% |
| Cyclohexane | | 0.00% | 5.07% | 0.21% | 0.01% | | 5.56% | 0.74% | 0.01% |
| n-Heptane | | 0.00% | 5.85% | 0.12% | 0.00% | | 6.46% | 0.45% | 0.00% |
| Methylcyclohexane | | 0.00% | 5.79% | 0.13% | 0.00% | | 6.39% | 0.47% | 0.00% |
| Toluene | | 0.00% | 4.06% | 0.05% | 0.00% | | 4.52% | 0.19% | 0.00% |
| n-Octane | | 0.00% | 4.10% | 0.03% | 0.00% | | 4.56% | 0.10% | 0.00% |
| n-Nonane | | 0.00% | 7.35% | 0.02% | 0.00% | | 8.20% | 0.06% | 0.00% |
| VAPOR | | | | | | | | | |
| MASS FLOW RATE | lb hr | | 679 | 32,662 | 2,161 | | 585 | 2,976 | 2,187 |
| LIGHT LIQUID | | | | | | | | | |
| MASS FLOW RATE | lb/hr | 24,191 | 21,674 | 38,593 | 194,186 | — | 20,356 | 21,375 | 185,974 |
| ACTUAL VOL. FLOW | GPM | 105 | 60 | 149 | 1,122 | — | 55 | 84 | 1,103 |

Note:
Separator Liquids temperature and pressure conditions given above are downstream of respective level control valves.

TABLE 3

Feed and Product Material Balance

| STREAM NAME | | Feed Gas (2) | Residue Gas (54) | C2+ (70) | Ethane (220) | Propane (224) | Butane (268) | Condensate (270) |
|---|---|---|---|---|---|---|---|---|
| TEMPERATURE | F. | 70 | 50 | 183 | 48 | 120 | 121 | 104 |
| PRESSURE | Psia | 855 | 463 | 465 | 420 | 245 | 85 | 88 |
| MASS FLOW RATE | lb/hr | 1,446,218 | 1,391,056 | 79,359 | 8,278 | 36,328 | 9,496 | 25,258 |
| COMPOSITON | Mole % | | | | | | | |
| Helium | | 0.05% | 0.05% | 0.00% | 0.00% | 0.00% | 0.00% | 0.00% |
| CO2 | | 0.00% | 0.00% | 0.00% | 0.03% | 0.00% | 0.00% | 0.00% |
| H2S | | 0.00% | 0.00% | 0.00% | 0.00% | 0.00% | 0.00% | 0.00% |
| Nitrogen | | 0.18% | 0.18% | 0.00% | 0.00% | 0.00% | 0.00% | 0.00% |
| Methane | | 97.29% | 98.42% | 0.16% | 0.89% | 0.00% | 0.00% | 0.00% |
| Ethane | | 1.45% | 1.17% | 16.47% | 93.20% | 0.35% | 0.00% | 0.00% |
| Propane | | 0.50% | 0.17% | 54.41% | 5.88% | 99.55% | 0.62% | 0.00% |
| i-Butane | | 0.10% | 0.00% | 5.45% | 0.00% | 0.10% | 50.37% | 0.24% |
| n-Butane | | 0.10% | 0.00% | 5.50% | 0.00% | 0.00% | 48.61% | 1.83% |
| i-Pentane | | 0.03% | 0.00% | 1.67% | 0.00% | 0.00% | 0.38% | 8.90% |
| n-Pentane | | 0.03% | 0.00% | 1.67% | 0.00% | 0.00% | 0.02% | 9.10% |
| n-Hexane | | 0.03% | 0.00% | 1.65% | 0.00% | 0.00% | 0.00% | 9.00% |
| Methylcyclopentane | | 0.02% | 0.00% | 1.10% | 0.00% | 0.00% | 0.00% | 6.00% |
| Benzene | | 0.06% | 0.00% | 3.29% | 0.00% | 0.00% | 0.00% | 17.91% |
| Cyclohexane | | 0.03% | 0.00% | 1.64% | 0.00% | 0.00% | 0.00% | 8.94% |
| n-Heptane | | 0.03% | 0.00% | 1.61% | 0.00% | 0.00% | 0.00% | 8.76% |
| Methylcyclohexane | | 0.03% | 0.00% | 1.61% | 0.00% | 0.00% | 0.00% | 8.76% |
| Toluene | | 0.02% | 0.00% | 1.05% | 0.00% | 0.00% | 0.00% | 5.73% |
| n-Octane | | 0.02% | 0.00% | 1.00% | 0.00% | 0.00% | 0.00% | 5.45% |
| n-Nonane | | 0.03% | 0.00% | 1.72% | 0.00% | 0.00% | 0.00% | 9.40% |

TABLE 3-continued

Feed and Product Material Balance

| STREAM NAME | | Feed Gas (2) | Residue Gas (54) | C2+ (70) | Ethane (220) | Propane (224) | Butane (268) | Condensate (270) |
|---|---|---|---|---|---|---|---|---|
| VAPOR | | | | | | | | |
| STD VOL. FLOW | MMSCFD | 787.57 | 778.55 | | | 0.00 | | |
| LIGHT LIQUID | | | | | | | | |
| MASS FLOW RATE | lb/hr | — | — | 79,359 | 8,278 | 36,327 | 9,496 | 25,258 |
| ACTUAL VOL. FLOW | GPM | — | — | 346 | 43 | 161 | 36 | 70 |

TABLE 4

Startup with solvent

| Startup Step | Startup Step Description | Fresh Propane GPM | Recycled Propane GPM | Residue Recycle % | Warm Separator Liquids | Cold Separator Liquids | Expander Separator Liquids | Cold Separator Inlet Temp, F. |
|---|---|---|---|---|---|---|---|---|
| | | | | | Margin to Freeze, C. | | | |
| 1 | Begin Cooling Inlet Gas, liquid starts forming in separators. Expander bypassed, gas through JT valve. DeMethanizer overhead flared. | 0 | 0 | 0 | 11 | 21 | 10 | 3 |
| 2 | Residue recycle started. | 0 | 0 | 35% | 19 | 21 | 9 | −1 |
| 3 | Fresh propane added. Residue Recycle increased. | 100 | 0 | 70% | 11 | 21 | 9 | −10 |
| 4 | Continue to cool plant | 100 | 0 | 70% | 8 | 15 | 6 | −20 |
| 5 | Expander on. | 100 | 0 | 70% | 10 | 11 | 7 | −30 |
| 6 | DeMethanizer overhead to residue. Fractionation train on. DePropanizer overhead recycled back to inlet, start decreasing fresh propane | 83 | 17 | 70% | 16 | 9 | 12 | −40 |
| 7 | Continue cooling plant, decreasing fresh propane | 40 | 150 | 70% | 10 | 11 | 55 | −55 |
| 8 | Continue cooling plant, decreasing fresh propane | 40 | 150 | 70% | 11 | 12 | 55 | −70 |
| 9 | All solvent injection from fractionation train. | 0 | 190 | 70% | 12 | 13 | 53 | −80 |
| 10 | Decrease residue recycle | 0 | 190 | 40% | 12 | 21 | 50 | −96 |
| 11 | No residue recycle. Decrease amount of solvent. | 0 | 105 | 0% | 10 | 10 | 48 | −96 |

TABLE 5

Startup without solvent

| Startup Step | Startup Step Description | Fresh Propane GPM | Recycled Propane GPM | Residue Recycle % | Warm Separator Liquids | Cold Separator Liquids | Expander Separator Liquids | Cold Separator Inlet Temp, F. |
|---|---|---|---|---|---|---|---|---|
| | | | | | Margin to Freeze, C. | | | |
| 1 | Begin Cooling Inlet Gas, liquid starts forming in separators. Expander bypassed, gas through JT valve. DeMethanizer overhead flared. | 0 | 0 | 0 | 11 | 21 | 10 | 3 |
| 2 | Residue recycle started. | 0 | 0 | 0 | 17 | 16 | 6 | −1 |
| 3 | Fresh propane added. Residue Recycle increased. | 0 | 0 | 0 | 17 | 15 | 6 | −2 |
| 4 | Continue to cool plant | 0 | 0 | 0 | 13 | 9 | 0 | −10 |
| 5 | Expander on. | 0 | 0 | 0 | 11 | 1 | −7 | −20 |
| 6 | DeMethanizer overhead to residue. Fractionation train on. DePropanizer overhead recycled back to inlet, start decreasing fresh propane | 0 | 0 | 0 | 10 | −6 | −12 | −30 |

TABLE 5-continued

| Startup Step | Startup Step Description | Fresh Propane GPM | Recycled Propane GPM | Residue Recycle % | Warm Separator Liquids | Cold Separator Liquids | Expander Separator Liquids | Cold Separator Inlet Temp, F. |
|---|---|---|---|---|---|---|---|---|
| | Startup without solvent | | | | | | | |
| | | | | | Margin to Freeze, C. | | | |
| 7 | Continue cooling plant, decreasing fresh propane | 0 | 0 | 0 | 8 | −12 | −15 | −40 |
| 8 | Continue cooling plant, decreasing fresh propane | 0 | 0 | 0 | 8 | −19 | 2 | −55 |
| 9 | All solvent injection from fractionation train. | 0 | 0 | 0 | 8 | −23 | 18 | −70 |
| 10 | Decrease residue recycle | 0 | 0 | 0 | 8 | −23 | 30 | −80 |
| 11 | No residue recycle. Decrease amount of solvent. | 0 | 0 | 0 | 8 | −23 | 40 | −96 |

The example shown in FIGS. 1-2 is for a C2+ recovery process. The solvent injection and residue recycle scheme can be implemented in conjunction with other C2+ recovery schemes. The process can also be applied for a C3+ or C4+ recovery process. The configuration of the plant and amount of C2+, C3+ and C4+ components varies as required for each application.

At lower temperature the concentration of the freeze component must be lower to prevent freezing. Use of multiple liquid separation points results in less solvent being required. Use of multiple separation points therefore also reduces the total cooling energy needed to remove the high freeze point components. Furthermore, use of multiple separation points reduces or eliminates pinch points in the heating/cooling curves of the heat exchangers by reducing the total liquid condensation.

Use of a solvent that is more volatile than all of the freezing components being removed allows complete separation of the solvent for re-use without the possibility of contamination with freezing components. Furthermore, use of a solvent that is more volatile than the freezing components allows some of the solvent to liquefy in more than one of the sequential separation points.

In embodiments, the solvent comprises C3 and/or C4 hydrocarbons, such as propane and butane. Use of propane and/or butane solvents provides liquid solvent within the process with a low heat of condensation per mol, minimizing the duty and the heat exchanger cooling curve deflection from condensing the solvent.

It is important that an adequate amount of the solvent components be present as liquid at or prior to condensation and potential freezing of the freeze components in each step of the present invention where the stream is cooled, including the heat exchangers and pressure drop devices. It is also important that the solvent is present as a liquid in adequate amounts at every point throughout the cooling process to prevent freezing.

Stream composition, temperature and pressure along with freeze point algorithms can be used to predict freezing conditions, and can be used for control of solvent injection rate and location during start-up and steady state operation. Operating conditions that indicate the possibility of freezing including higher than normal pressure drops and lower than normal heat exchange, can be monitored and used as feedback for control of the solvent injection rate and location.

Application of the embodiments described herein for removal of high freeze point components upstream of a gas liquefaction facility requires that all components that could freeze in the liquefaction plant be removed. In some cases, pentane and heavier components would not be useful as solvent, as there are strict limits on amount of these components entering the liquefaction plant.

Use of the process shown in FIGS. 1-2 upstream of a gas liquefaction facility provides the benefit that recovery of solvent components in a fractionation train will also provide components for the mixed refrigerants commonly used in the liquefaction facility. Use of solvent components that are normally available in the feed gas, and are also allowable in the downstream process, is an additional feature and benefit of certain embodiments described herein.

Addition of the solvent increases the density of the liquid phase, enhancing separation of the liquid, including contained freeze components, from the vapor. Addition of the solvent increases the surface tension of the liquid, further enhancing separation and recovery of the liquid. Addition of the solvent allows condensation and recovery of the freeze components at higher temperature, where the relative physical properties of the vapor and liquid are more favorable for separation.

Dilution of the freeze components into the solvent reduces the volume of freeze component liquid carried over in any droplets that are not recovered in the liquid phase in separation vessels, reducing the negative effect of droplet carryover.

At times it may be necessary to design and operate a plant for BTEX and C5+ removal to avoid freezing, wherein the feed composition may vary from very lean to very rich in C3+ components, with one or more different average gas compositions. Recycle of solvent components may be necessary to avoid freezing when the feed gas is lean C3+ hydrocarbons. Recycle may not be required in the C3+ rich feed gas case. The C3 and/or C4 rich case may require the largest equipment due to the higher recovery of liquids. Separators and towers will be larger when designed to accommodate a rich gas case (see below). The high loading case may set minimum sizes for the plant equipment, and these sizes may be larger than are required for the lean gas case.

In order to have all equipment operate well, it is desirable to have all equipment operating at a reasonable design operating point to ensure proper performance. Recycle of liquids to prevent freezing in lean gas cases has the secondary effect of increasing the load on equipment, possibly to the same loading as for the C3+ rich gas case. This unexpected result of avoiding freezing has a positive effect on plant performance. Recycle can be used to both prevent freezing, and concurrently to equilibrate equipment loads for different feed gas cases. Recycle of propane and butane streams may allow the feed gas composition to approach being unchanged; not only avoiding freezing, but surprisingly resulting in a very similar feed gas with nearly identical operating conditions and loads for all equipment.

Typically, plant operating conditions are adjusted to achieve desired results with different feed gases. With the embodiments described herein, the use of recycle to avoid freezing also results in a significantly simplified operation. When the feed gas changes the recycle rate can be changed, and all other operating conditions do not require significant adjustment, making operation for changing feed compositions much easier. This scenario requires only one item to change instead of multiple items.

A new plant design for heavy hydrocarbon and BTEX removal from very lean natural gas before liquefaction generally includes at least two separation vessels, at least one heat exchanger, at least one pressure reduction device, and solvent injection points upstream of two or more of these pieces of equipment. Propane and butane are readily available, can be shipped and stored in tankage at a facility site, and can be transferred to the plant facility for start-up use following a sequence of adding solvent components as feed gas is introduced to the plant to pressure it up to operating pressure. A portion of the gas can be recirculated through the plant without flaring using the compressor, cooling the plant using the pressure drop device, adding solvent components until the solvent has established all liquid levels required for normal operation, and cooling the process to normal operating temperatures. With this system, there is little if any delay, waste, or flare emissions during start-up. The use of solvents available from the inlet gas, and that are also readily available for purchase, allows for this low emissions start-up method, and also allows refill of onsite storage of solvent for any future needs.

An illustrative embodiment is shown in detail in FIG. 1. Feed Gas Stream 2, typically pipeline grade natural gas, becomes part of Stream 3 and is passed through an Inlet Heat Exchanger 4, thereby cooling and liquefying at least a portion of the Feed Gas to form a Cooled Feed Gas 6. The Cooled Feed Gas 6 is sent to a Warm Separator 8 in which heavy hydrocarbon liquids (i.e. C2+ hydrocarbons) are separated from the lighter gas components, primarily methane and other non-condensable gases such as nitrogen, carbon dioxide, helium and the like that may be in the Feed Gas. The Warm Separator Overhead Gas Stream 10, composed of methane rich hydrocarbons plus any residual non-condensed heavy hydrocarbons resulting from the Warm Separator 8, is subsequently passed through a Cryogenic Gas/Gas Heat Exchanger 18 and further cooled to form the Cold Separator Feed 20 for the Cold Separator 22. The Warm Separator Bottoms Stream 12, comprising the condensed heavy hydrocarbon liquids, is drawn off the bottom of the Warm Separator 8 and passed through the Warm Separator Bottom Stream Control Valve 14 and is then designated as stream 15. Stream 15 is combined with other streams to form the Combined Methane Lean Hydrocarbons stream 16.

Returning to the Cold Separator 22, condensable hydrocarbons in the Cold Separator Feed 20 are separated from a methane rich gaseous phase in the Cold Separator 22. The methane rich gaseous phase is withdrawn from the Cold Separator 22 as the Cold Separator Overhead Stream 24. The condensable hydrocarbons are removed from the Cold Separator 22 to form the Cold Separator Bottoms Stream 26 which is passed through the Cold Separator Bottoms Stream Heater 28 and subsequently the Cold Separator Bottoms Stream Control Valve 30. After passing through the Cold Separator Bottoms Stream Control Valve 30, the reduced pressure Cold Separator Bottoms Stream 31 is utilized in the Cryogenic Gas/Gas Heat Exchanger 18 as the cooling medium, absorbing the heat in the Warm Separator Overhead Stream 10. This forms a Methane Lean Stream 32 of hydrocarbons that is combined with the Warm Separator Bottoms Stream 12 to form the Combined Methane Lean Hydrocarbons 16.

The Cold Separator Overhead Stream 24, is routed to an Expander/Compressor 34 and is simultaneously expanded and cooled to form an Expanded and Cooled Methane Rich Hydrocarbon Stream 36. The Expanded and Cooled Methane Rich Hydrocarbon Stream 36 is directed to the Expander Separator 38 where any uncondensed, methane rich gas is separated from any remaining condensable hydrocarbons to form the Expander Separator Overhead Stream 40. The condensable hydrocarbons in the Expander Separator are withdrawn as Expander Separator Bottom Stream 42, which is passed through the Expander Separator Bottoms Stream Control Valve 44 exiting the control valve as Low Pressure Expander Separator Bottom Stream 45. Stream 45 is combined with the reduced pressure Cold Separator Bottoms Stream 31 after the Cold Separator Bottoms Stream 31 has passed through the Cold Separator bottoms Stream Control Valve 30, but prior to entry into the Cryogenic Gas/Gas heat Exchanger 18.

The Expander Separator Overhead Stream 40, is passed through the Demethanizer Reflux Condenser 46 as a cooling medium, thus absorbing the heat in the Compressed Demethanizer Overhead Gas 74. The resulting Methane Rich Hydrocarbon Stream 48 remains very cold and thus is routed to the Cryogenic Gas/Gas Heat Exchanger 18 and the Inlet Heat Exchanger 4 as a cooling medium, thus absorbing the heat in the respective feeds. After leaving the Inlet Heat Exchanger 4, the Methane Rich Hydrocarbon Stream 48 is compressed in a first stage by the Expander/Compressor 34 and then a second stage Residue Gas Compressor 50 prior to being cooled by an Air Cooler 52 to form a Methane Rich Feed Gas 54 for an LNG Plant. A side stream Methane Recycle Loop 56 and Methane Recycle Loop Control Valve 58 may be included to allow the recycling of a portion of the Methane rich Feed Gas for an LNG Plant 54 back into the Feed Gas 2 stream. The purpose of such recycling was described above and will be explained in greater detail below.

The Combined Methane Lean Hydrocarbon Stream 16 is routed to a Demethanizer column 60 and undergoes further fractionation and removal of any residual methane. Any residual methane is removed as the Demethanizer Overhead Stream 62 and any condensable hydrocarbons from a methane lean fraction and is removed as the Demethanizer Bottoms Stream 64. A first portion of the Demethanizer Bottoms Stream 64 is passed through a Demethanizer Reboiler 66 and returned to the Demethanizer as the Demethanizer Reboiler Feed 68. However, a second portion of the Demethanizer Bottoms Stream 64 is utilized to form a C2+ Hydrocarbon Stream 70. The Demethanizer Overhead Stream 62 is recompressed in the Demethanizer Overhead Gas Compressor 72 to form the Compressed Demethanizer Overhead Gas Stream 74 which is subsequently cooled in the Demethanizer Reflux Condenser 46. The Cooled Demethanizer Overhead Gas 76 is passed to the Demethanizer Reflux Accumulator 78 in which any liquidized portions are removed as a Demethanizer Reflux Accumulator Bottoms Stream 80 and routed as a reflux stream back to the Demethanizer 60. The gaseous portions of the Cooled Demethanizer Overhead Stream 76 are taken from the Demethanizer Reflux Accumulator 78 as a Demethanizer Reflux Accumulator Overhead Stream 82, routed to the Demethanizer Reflux Condenser 46 where the Demethanizer Reflux Accumulator Overhead Stream 82 is further cooled after which the Demethanizer Reflux Accumulator Overhead Stream 82 is routed to the Expander Separator 38 as high purity methane gas.

When starting up the above process, the Feed Gas 2, may be lean on middle range hydrocarbons, C3, C4 and C5 hydrocarbons, but have a significant concentration of heavier hydrocarbons such a C6+ hydrocarbons such a cyclohexane, benzene, toluene and the like. Such condensable heavy hydrocarbons, especially benzene present an operator with a very serious challenge. That is, the cold conditions of the plant are such that those heavy hydrocarbons can freeze out and form solid hydrocarbons which hinder and/or block the passage of feed gas into the plant. Under such circumstances, in a conventional process, an operator must stop operations and slowly allow the plant to warm-up thereby allowing the melting of the solid hydrocarbons and removal of the blockage. This results in costly, unproductive time and expense in having to re-cool down the plant to the temperatures needed to process the feed gas. This risk to the operation of the plant is not only present during start-up, but also is present during on-going operations when the composition of the feed gas changes. That is, if the feed gas has a sudden increase in the content of heavy hydrocarbons, especially benzene, by only a few hundredths of a percent, the change can result in the accumulation of frozen solid hydrocarbons and blockage of the Inlet Exchanger 4, the Warm Separator 8 and the Cryogenic Gas/Gas Heat Exchanger 18.

To resolve this problem, it has been unexpectedly discovered that the injection of a C3 propane, C4 butane or mixtures thereof into the otherwise lean Feed Gas significantly reduces and practically eliminates the formation of frozen heavy hydrocarbons. It is believed that the C3 propane, C4 butane or mixtures thereof serve as an in situ "solvent" or "antifreeze" against the formation of solid heavy hydrocarbons. As shown in FIG. 1, the C3 propane, C4 butane or mixtures thereof "antifreeze" may be injected into the feed gas in stream 84 at a point prior to the introduction of the Feed Gas 2 into the Inlet heat Exchanger 4 in streams 86 and/or 87. In embodiments, it can be advantageous to inject the C3 propane, C4 butane or mixtures thereof "antifreeze" into the Warm Separator Overhead Stream 10 prior to Cryogenic Gas/Gas heat Exchanger 18. Not wishing to be limited, however, the injection or use of the C3 propane, C4 butane or mixtures thereof "antifreeze" can be injected into a number of other places that may be subject to heavy hydrocarbon freeze-up, for example, prior to the Cold Separator 22 to prevent blockage of the Cold Separator, as part of the Cold Separator Bottoms Stream 26 or the Expander Separator Bottoms Stream 42, prior to the Cryogenic Gas/Gas heat Exchanger to prevent blockage of the flow, or even into the Combined Methane Lean Hydrocarbons Stream 16 to prevent freeze up and blockage of that line.

It has also been unexpectedly discovered that the injection of a C3 propane, C4 butane or mixtures thereof into the Feed Gas and other locations as noted above significantly reduces the time it takes to start-up the plant. The time it takes for the operator to undertake a systematic and sequential plant cool down process can be significantly reduced as a result of the injection of C3 propane, C4 butane or mixtures thereof helping to cool the plant and prevent the formation of blockages caused by frozen heavy hydrocarbons in the otherwise lean Feed Gas. This shorter time to operational stability not only saves the operator time, but also results in substantial environmental benefits. Because the plant is cooled down faster and with substantially reduced risk of heavy hydrocarbon freeze-up or blockage, less venting or flaring of off-specification methane gas is needed. That is the methane gas that is not suitable for use as a feed to the LNG plant can be recycled and reused via the Methane Recycle Loop 56 without concern of making the Feed Gas even leaner in on middle range hydrocarbons and even more susceptible to heavy hydrocarbon freeze-up. The utilization of the combination of the Methane Recycle Loop 56 and the injection of C3 propane, C4 butane or mixtures thereof into the Feed Gas and other locations as noted above allows the operator to achieve a steady state operation for the plant and thus feeding the LNG plant with a higher quality on-specification feed from the first opening of the feed valves. One will appreciate such benefits to the operation of the LNG plant of having high quality, on-specification methane rich feed gas from the start of operation. This benefit is further enhanced by the fact that the present process utilized pipeline quality natural gas as the primary feed source resulting in substantial cost savings to the operator.

One source for the C3 propane, C4 butane or mixtures thereof "antifreeze" is stored or commercially purchased propanes or butanes. However, considerable benefits can be realized by using the C2+ hydrocarbon stream 70 generated in the above process as the source for such C3 propane, C4 butane or mixtures thereof. Thus with reference to FIG. 2, another illustrative embodiment includes the generation of the C3 propane, C4 butane or mixtures thereof "antifreeze" utilizing the illustrated process scheme. The C2+ Hydrocarbon stream 70 from the Demethanizer 60 (in FIG. 1) is routed to a Deethanizer column 202. Within the Deethanizer column 202, the C2 hydrocarbon gas (generically referred to herein as "ethane gas") is fractionally distilled out of the feed and removed as the Deethanizer Overhead Stream 210. The remaining C3+ condensable hydrocarbons are taken from the Deethanizer 202 as the Deethanizer Bottoms Stream 204. A first portion of the Deethanizer Bottoms Stream 204 is routed to the Deethanizer Reboiler 206 and returned back into the Deethanizer Column 202 as the Deethanizer Reboiler Stream 208. A second portion of the Deethanizer Bottoms Fraction 222 which is composed of C3+ Hydrocarbons is routed to and serves as feed to the Depropanizer 224. Turing back to the Deethanizer Overhead Stream 210, this ethane rich stream is passed through a Deethanizer Condenser 212, cooled and then to a Deethanizer Reflux Accumulator 214. Within the Deethanizer Reflux Accumulator 214 the liquefied high purity ethane is removed as the Deethanizer Reflux Accumulator Bottoms Stream 215 and is pumped via the Deethanizer Reflux Pump 216 back to the Deethanizer 202 as a Deethanizer reflux Stream 218. A portion of that Deethanizer Reflux Stream may be removed as a high purity ethane Deethanizer product Stream—Ethane 220. While removal of the Ethane component from the C3 propane, C4 butane or mixtures thereof "antifreeze" may not be necessary, it does provide the operator with the opportunity to generate a valuable high purity Ethane stream which may be sold or used elsewhere in the refinery or plant.

The C3+ Hydrocarbons 222 from the Deethanizer 202 are routed to a Depropanizer column 224. Within the Depropanizer column 202, C3 hydrocarbon gas (herein generically referred to as propane) is fractionally distilled out of the feed and removed as the Depropanizer Overhead Stream 232. The remaining C4+ condensable hydrocarbons are taken from the Depropanizer 224 as the Depropanizer Bottoms Stream 226. A first portion of the Depropanizer Bottoms Stream 226 is routed to the Depropanizer Reboiler 228 and returned back into the Depropanizer Column 224 as the Depropanizer Reboiler Stream 230. A second portion of the Depropanizer Bottoms Fraction 246 which is composed of C4+ Hydrocarbons is routed to and serves as feed to the Debutanizer 248. Turning back to the Depropanizer Overhead Stream 232, this propane rich stream is passed through a Depropanizer Condenser 234, cooled and then to a Depropanizer Reflux Accumulator 236. Within the Depropanizer Reflux Accumulator 236 the liquefied high purity propane is removed as the Depropanizer Reflux Accumulator Bottoms Stream 238 and is pumped via the Depropanizer Reflux Pump 240 back to the Depropanizer 224 as a Depropanizer reflux Stream 242. A portion of that Depropanizer Reflux Stream may be removed as a high purity C3 hydrocarbon stream as the Depropanizer Product Stream—Propane 244.

The C4+ Hydrocarbon stream 246 from the Depropanizer 224 is routed to a Debutanizer column 248. Within the Debutanizer 248, C4 hydrocarbon gas (herein generically referred to as butane) is fractionally distilled out of the feed and removed as the Debutanizer Overhead Stream 256. The remaining C5+ condensable hydrocarbons are taken from the Debutanizer 248 as the Debutanizer Bottoms Stream 250. A first portion of the Debutanizer Bottoms Stream 250 is routed to the Debutanizer Reboiler 252 and returned back into the Debutanizer 248 as the Debutanizer Reboiler Stream 254. A second portion of the Debutanizer Bottoms Fraction 250 which is composed of C5+ Hydrocarbons and other high freeze point components are routed to and serves as feed other units in the Plant or refinery as natural gas condensate stream 270. Turning back to the Debutanizer Overhead Stream 256, this butane rich stream is passed through a Debutanizer Condenser 258, cooled and then to a Debutanizer Reflux Accumulator 260. Within the Debutanizer Reflux Accumulator 260 the liquefied high purity butane is removed as the Debutanizer Reflux Accumulator Bottoms Stream 262 and is pumped via the Debutanizer Reflux Pump 264 back to the Debutanizer 248 as a Debutanizer reflux Stream 266. A portion of that Debutanizer Reflux Stream may be removed as a high purity C4 hydrocarbon stream as the Debutanizer Product Stream—Butane 268.

The high purity C3 hydrocarbon stream from the Depropanizer Product Stream—Propane 244 and the high purity C4 hydrocarbon stream from the Debutanizer Product Stream—Butane 268 can be used separately and/or combined and utilized as the C3 propane, C4 butane or mixtures thereof "antifreeze" noted above. Thus by such operations, the materials needed to substantially reduce the risk or prevent the formation of frozen heavy hydrocarbon blockages can be generated during the course of the on-going operations of the LNG plant feed pre-treatment process described herein.

Second Embodiment

Figure 3:
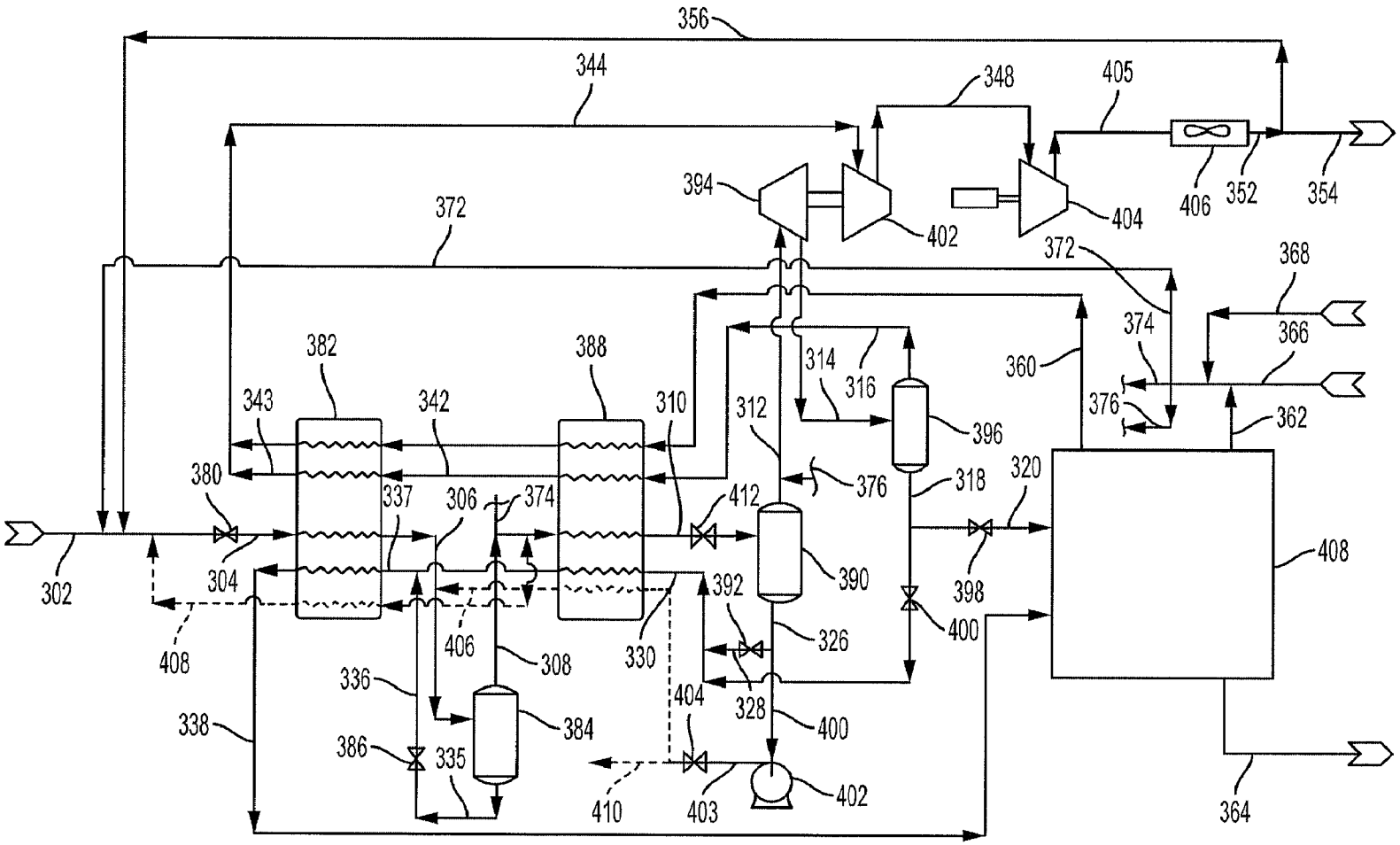
FIG. 3 schematically depicts a second embodiment of a system and process for extracting high freeze point hydrocarbons from a gas stream.

FIG. 3 shows another embodiment of a freeze component removal process that utilizes C3's and C4's recovered in the process and separated in fractionation section towers to prevent freezing by recycling these C3 and/or C4's to points in the plant to dilute the concentration of freeze components in the liquid portion of the process streams. The points in the process most subject to freezing include points where liquid is auto-refrigerated by pressure drop across control valves, and any point during cooling wherein the ratio of freezing to non-freezing components is high in the liquid phase, including the point of incipient liquid formation when a vapor stream leaving a separator is further cooled.

The Fractionation block in FIG. 3 includes industry standard distillation towers and will typically include at least a deethanizer to remove methane and ethane from recovered liquids, and a debutanizer to separate the C3 and C4 components from the C5+, benzene and other heavy components that could freeze in the main process. The recovered C3 and C4 components may be entirely recycled for freeze protection, or may alternatively be sold as a product or routed to liquefaction with the purified main gas stream.

FIG. 3 also depicts an embodiment in which all or a portion of the liquid recovered in the Cold Separator is recycled to enter one or more points upstream of the Cold Separator, including in the feed gas stream entering the Warm Exchanger. The equipment shown in dotted lines is additional equipment comprising the second embodiment.

Table 6, Freezing Suppression, presents sets of data at select points in the process where freezing might occur. The "first embodiment" data set utilizes the complete recycle and injection of C3 and C4 stream from Fractionation, and indicates freeze points. The "Second embodiment" data set includes the recycle of the First Embodiment and also utilizes the process of the second embodiment.

TABLE 6

Freezing Suppression

| | | First embodiment | | | | Second embodiment | | | |
|---|---|---|---|---|---|---|---|---|---|
| STREAM NAME | Stream Number | T deg F./ Pres psia | Benzene mol/hr | Benzene ppm | Deg C. from Freezing | T deg F./ Pres psia | Benzene mol/hr | Benzene ppm | Deg C. from Freezing |
| Feed Gas | 302 | 57.5/578 | 24.25 | 301 | | 57.5/578 | 24.25 | 301 | |
| C3/C4 Recycle to Feed Gas | 372 | 158/581 | 0 | 0 | | 161/581 | 0 | 0 | |
| Cold Separator Liquid to Feed Gas Recycle | 408 | — | — | — | — | 46/616 | 6.83 | 3,416 | |
| Reduced Pressure Feed Gas (mixed w/ recycles) | 304 | 55.3/572 | 24.25 | 299 | | 51/572 | 31.09 | 374 | |
| Feed Gas in Warm Exchanger (note 1) | | | | | −2.4@ −30 F. | | | | +7.3@ −22 F. |
| Warm Separator Overhead Stream | 308 | −30/565 | 18.1 | 223 | | −30/565 | 11.11 | 134 | |
| Warm Separator Liquids | 335 | −30/565 | 6.16 | 295,000 | −2.4 | −30/565 | 19.97 | 139,800 | +7.3 |
| Warm Separator Liquids Downstream of Level Control Valve (L) | 336 | −35/405 | 6.16 | 319,000 | −5.5 | −37/405 | 19.97 | 153,100 | +3.5 |

TABLE 6-continued

| Freezing Suppression | | | | | | | | | |
|---|---|---|---|---|---|---|---|---|---|
| | | First embodiment | | | | Second embodiment | | | |
| STREAM NAME | Stream Number | T deg F./ Pres psia | Benzene mol/hr | Benzene ppm | Deg C. from Freezing | T deg F./ Pres psia | Benzene mol/hr | Benzene ppm | Deg C. from Freezing |
| Feed Gas in Cold Exchanger (note 1) | | | | | −4.1 @−40 F. | | | | +7.2 At inlet |
| Cold Separator Overhead Stream | 312 | −103/555 | 0.340 | 4 | | −104/555 | 0.093 | 1 | |
| Cold Separator Bottoms Stream | 326 | −103/556 | 17.75 | 14,500 | | −104/555 | 11.02 | 3,416 | +26 |
| Cold Separator Bottoms Stream Downstream of Level Control Valve (L) | 328 | −120/405 | 17.75 | 16,720 | −0.5 | −120/405 | 4.19 | 3958 | +21 |
| Expander Separator Overhead Stream | 316 | −123/447 | 0.007 | <1 | | −123/447 | .0018 | <1 | |
| Expander Separator Bottoms Stream | 318 | −123/448 | 0.33 | 507 | | −123/448 | 0.092 | 126 | |
| Expander Separator Bottoms Stream Downstream of Level Control Valve (L) | 320 | −139/390 | 0.33 | 539 | | −130/390 | 0.092 | 134 | |
| Methane Rich Gas To LNG Plant | 354 | 113/1074 | 0.008 | <1 | | 113/1074 | .002 | <1 | |

"(L)" indicates "Liquid Phase" portion of the Stream.

"(note 1)":

Freeze points in the exchanger when partially cooled are detected; the degrees C. of freezing is the first number, and the second is the temperature at which this freezing occurs. Negative numbers indicate freezing. Positive numbers indicate the degrees above the freeze point, and in the case of exchangers, indicates the closest approach to freezing in the exchanger.

TABLE 7

| Feed, Product and Recycle Material Balances | | | | | | | | |
|---|---|---|---|---|---|---|---|---|
| | | Stream Number | | | | | | |
| STREAM NAME | | 302 Feed Gas | 354 Methane-Rich Gas To LNG | 364 Benzene and C5-Plus From Fractionation | 372 C3 & C4 To Feed Gas | 408 Cold Separator Recycle to Feed Gas | 304 Reduced Pressure Feed Gas | First embodiment stream 26 Cold Separator Bottoms Liquid |
| TEMPERATURE | F. | 57.5 | 113 | 334 | 161 | −103 | 51 | −103 |
| PRESSURE | Psia | 578 | 1074 | 185 | 581 | 626 | 572 | 556 |
| MOLAR FLOW RATE | Lb-Moles/hr | 80,623 | 80,576 | 47.66 | 473 | 2000 | 83096 | 1266 |
| COMPOSITON | Mole % | | | | | | | |
| Nitrogen | | 0.412% | 0.412% | 0.000% | 0.000% | 0.069% | 0.402% | 0.064% |
| Methane | | 98.267% | 98.325% | 0.000% | 0.009% | 66.934% | 96.954% | 64.909% |
| Ethane | | 1.086% | 1.086% | 0.000% | 1.213% | 6.563% | 1.218% | 6.650% |
| Propane | | 0.128% | 0.128% | 0.000% | 18.574% | 5.202% | 0.356% | 5.267% |
| i-Butane | | 0.023% | 0.023% | 0.028% | 23.180% | 5.832% | 0.295% | 5.816% |
| n-Butane | | 0.026% | 0.025% | 2.403% | 57.017% | 14.422% | 0.697% | 14.486% |
| i-Pentane | | 0.009% | 0.000% | 15.154% | 0.006% | 0.336% | 0.017% | 0.514% |
| n-Pentane | | 0.006% | 0.000% | 10.152% | 0.000% | 0.200% | 0.011% | 0.351% |
| n-Hexane | | 0.005% | 0.000% | 8.481% | 0.000% | 0.074% | 0.007% | 0.270% |
| Benzene | | 0.030% | 0.000% | 50.892% | 0.000% | 0.341% | 0.037% | 1.473% |
| n-Heptane | | 0.005% | 0.000% | 8.480% | 0.000% | 0.024% | 0.005% | 0.182% |
| n-Octane | | 0.002% | 0.000% | 4.070% | 0.000% | 0.004% | 0.002% | 0.042% |
| n-Nonane | | 0.000% | 0.000% | 0.339% | 0.000% | 0.000% | 0.000% | 0.000% |
| VAPOR | | | | | | | | |
| STD VOL. FLOW | MMSCFD | 734.3 | 733.8 | — | | | 756.8 | |
| LIGHT LIQUID | | | | | | | | |
| MASS FLOW RATE | lb/hr | — | — | 3828 | 26,095 | 55,083 | | |
| ACTUAL VOL. FLOW | GPM | — | — | 13.24 | 104 | 234.4 | | |

Table 7 is an overall material balance plus recycle streams for the second embodiment. First Embodiment Stream 26 is also included to allow comparison with the composition of Second Embodiment stream 208, which is a portion of the Cold Separator Bottoms Liquid, downstream of the Cold Separator Recycle Pump.

Table 8 below provides select stream and separator conditions for the First Embodiment and the Second Embodiment

TABLE 8

| Separator Conditions & Recycle Rates | | | | |
|---|---|---|---|---|
| | First Embodiment | | Second Embodiment | |
| Mol % Vapor Entering Separators | | | | |
| Warm Separator (384) | 99.97 | | 99.83 | |
| Cold Separator (390) | 98.49 | | 96.11 | |
| Expander Outlet Separator (396) | 99.18 | | 99.09 | |
| C3 & C4 to Feed Gas, Stream 372, mols/hr. | | | | |
| (All available C3 & C4 Stream is recycled to inlet in both processes.) | 405.5 | | 473 | |
| C3 & C4 in Stream 408, Cold Separator Recycle to Inlet | 0 | | 509 | |
| Total C3 & C4 recycled to inlet | 405.5 | | 982 | |
| Cold Separator Bottoms Stream 326 | | | | |
| Total Flow (326) | 1226 | | 3228 | |
| Flow to Fractionation (328) | 1226 | | 1228 | |
| Flow to Feed Gas (408) | 0 | | 2000 | |
| | First Embodiment | | Second Embodiment | |
| Conditions at inlet to each Separator | Temp, F. | Pres, psia | Temp, F. | Pres, psia |
| Warm Separator (384) | −30.1 | 566 | −30.1 | 566 |
| Cold Separator (390) | −103 | 556 | −103 | 558 |
| Expander Separator (396) | −123 | 449 | −123 | 450 |

The configuration and operating conditions may vary with each application made of the Second Embodiment.

As a minimum, the second embodiment includes the equipment necessary to recycle a portion of the condensed liquid from one of the separators to a separator upstream, resulting in removal of a larger quantity of the freezing components in the upstream separator with a lower concentration of freezing components in the liquid of both the separator upstream and the separator that is the source of the recycle liquid.

The second embodiment may include the equipment necessary to recycle a portion of the Cold Separator bottom Stream to a point in the process upstream of the Cold Separator.

The Cold Separator Liquid recycle stream may be routed to one or more of the following locations: the plant inlet gas, inlet gas entering the first exchanger, inlet gas exiting the first exchanger, a separate nozzle on the Warm Separator, and other upstream locations. The Cold Separator Liquid recycle stream may be reheated in one or more of the inlet gas heat exchangers. The heat exchangers are typically high-efficiency multiple stream heat exchangers made of brazed aluminum or other high efficiency design and construction.

The stream recycled from the Fractionation section is not limited to a C3/C4 mix; a stream containing any or all of components from C2 through C4 may be used, and a portion of the C5 may also be used as long as the concentration used does not lead to freezing.

An illustrative embodiment of the First embodiment is shown in FIG. 3. Feed Gas 302, typically pipeline grade natural gas, is routed through Inlet Valve 380, leaving as stream 304. This stream passes through a Warm Exchanger 382, cooling and liquefying at least a portion of the Feed Gas to form a Cooled Feed Stream Gas 306. The Cooled Feed Gas Stream 306 is sent to the Warm Separator 384 in which heavier hydrocarbon liquids (i.e. C2+ hydrocarbons) are separated from the lighter gas components, primarily methane and other non-condensable gases such as nitrogen that may be in the Feed Gas. The Warm Separator Overhead Stream 308 composed of methane rich lighter hydrocarbons plus any residual non-condensed heavy hydrocarbons resulting from the Warm Separator 384 is subsequently passed through Cold Exchanger 388 and further cooled to form the Cold Separator Feed Stream 310 which enters the Cold Separator 390. The Warm Separator Bottom Stream 335, comprising the condensed heavy hydrocarbon liquids, is drawn off the bottom of the Warm Separator 384 and passed through the Warm Separator Bottom Stream Valve 386, exiting as stream 336.

Returning to the Cold Separator 390, condensable hydrocarbons in the Cold Separator Feed Stream 310 are separated from a methane rich gaseous phase in the Cold Separator 390. The methane rich gaseous phase is withdrawn from the Cold Separator 390 as the Cold Separator Overhead Stream 312. The condensable hydrocarbons are removed from the Cold Separator 390 to form the Cold Separator Bottom Stream 326, a portion of which is passed through the Cold Separator Bottom Stream Control Valve 392. After passing through the Cold Separator Bottom Stream Control Valve 392, the reduced pressure Cold Separator Bottom Stream Valve Outlet Stream 328 is mixed with a portion of the Expander Outlet Separator Liquid Stream 318, after Stream 318 has passed through Expander Outlet Temperature Control Valve 400. The mixed stream 330 is utilized in the Cold Exchanger 388 as a cooling medium and thus absorbs the heat contained in the Warm Separator Overhead Stream 308. This forms a methane lean stream of hydrocarbons that is combined with the Warm Separator Bottoms Stream Valve Outlet 336 to form the Warm Exchanger Liquids Inlet 337. Stream 337 is heated in the Warm Exchanger 382, leaving as Warm Exchanger Liquids Outlet Stream 338, and is routed to Fractionation Zone 408.

The remaining portion of the Cold Separator Bottoms Stream 326 enters Cold Separator Recycle Pump 402, is increased in pressure and exits as Cold Separator Recycle Pump Outlet Stream 403. Stream 403 then flows though Cold Separator Recycle Flow Control Valve 404, is reheated in the Cold Exchanger 388 and is routed to points upstream, which may include Cold Separator Recycle to Warm Separator Stream 406, and or be routed through the Warm Exchanger and be routed to the Feed Gas as Cold Separator Recycle to Feed Gas Stream 408. Cold Separator Feed (gas) Stream 310 may flow through a Cold Separator Inlet Reduction Valve 412 to provide auto-refrigeration and creation of liquid additional liquid in the Cold Separator for recycle during start-up.

The Cold Separator Overhead Stream 312 is routed to Expander 394 and is simultaneously expanded and cooled to form Expander Outlet Stream 314. This stream enters the Expander Outlet Separator 396 where any uncondensed, methane rich gas is separated from any remaining condensable hydrocarbons to form the Expander Separator Overhead Stream 316 and Expander Separator Bottom Stream 318. A portion of bottoms stream 318 is passed through the Expander Outlet Separator Level Control Valve 398, exiting as Cold Stream 420, which is routed to Fractionation Section 408.

Stream 320 and Stream 338 enter Fractionation Section 408. A minimum of two distillation towers are typically installed in the fractionation area. This area makes use of standard equipment to separate the feed gas streams into any fractions desired for the facility. As a minimum, the heavy freeze components of C5+ and benzene are separated so as to not be recycled to the process, and these components leave Fractionation Section 408 as Benzene and C5+ From Fractionation Stream 364. A stream suitable for recycle to process to inhibit freezing must also be created, typically made of propane, butane, or a propane/butane mix as used in the present examples. The C3 and C4 mix recycled in the current embodiment exits as C3 and C4 Stream 362. A portion of Stream 362 may be sold or forwarded for use with elsewhere at the facility, or used to replenish C3 and C4 in storage as stream 366, which may be used for start-up. Make-up C3 and C4 from Storage can be provided in Stream 368. C3 and C4 Feed Gas Stream 372 is liquid from Stream 362 (or 368) which is recycled to the plant inlet. A portion of the C3 and C4 may also be routed to other equipment, as indicated by C3 and C4 to Warm Separator Overhead Stream 374 and C3 & C4 to Cold Separator Overhead Stream 376.

The Expander Separator Overhead Stream 316 is passed through the Cold Exchanger 388 and Warm Exchanger 382 as a cooling media, becoming Reheated Expander Separator Overhead Stream 343. C1 and C2 from Fractionation Stream 360 is also reheated in Cold Exchanger 388 and Warm Exchanger 382 and joins with Stream 343 to become Stream 344. Stream 361 may be increased in pressure using a compressor after being reheated. Stream 344 enters the Expander Compressor 402, leaving as higher pressure Recompressor Inlet Stream 348, and is routed to Recompressor 404, exiting at higher pressure as stream 405. Then cooled in Air Cooler 406 and exits as Cooled Recompressor Outlet Stream 352. A side stream Methane Recycle Loop 356 may be included to allow the recycling of a portion of the Cooled Recompressor Outlet Stream 352 to be recycled the Feed Gas for loading the plant equipment during times of low feed gas rate, or to aid in initial cool-down of the plant.

The embodiment of FIG. 3 may be used in conjunction with the embodiment of FIGS. 1-2. There are hard limits on the amount of C3 and C4 available for recycle and build-up in the plant. One is the amount of C3 and C4 in the feed gas. A second is losses of these components at equilibrium conditions at the point where the purified vapor has reached the specification for removal of the high freeze point component. This second point of limitation is the expander outlet separator vapor, wherein the overhead vapor product meets the LNG feed gas specifications. This is the also the coldest, lowest pressure location in the freeze component removal process. C3 and C4 components in stream 316 are routed to the LNG process and are no longer available for recycle. There may also be a relatively minor loss of C3 and C4 components in a C1 and C2 Stream 360 from fractionation and an even smaller loss in the C5+ stream from Fractionation Section 408.

As indicated in Tables 6 and 8, even when substantially all of the available C3 and C4 from Fractionation Section 408 has been recycled, freezing will still occur in the process. The recycle of C3 and C4 has built up the amount of these components in the feed to where they escape from the Expander Outlet Separator and an equilibrium point has been reached. Note that recycling stream 360 from Fractionation, which contains a small amount of C3 and C4 does not materially affect these results.

It is found that recycle of a portion of the Cold Separator Bottoms Stream 326 to upstream of the Warm Separator 384 could be of some value. The result of recycling a portion of the Cold Separator Bottoms Stream 326 was astonishing. Recycle of a portion of this low quality liquid containing significant benzene to upstream of the Warm Separator 384 created an internal recycle loop that (1) allowed a high rate of recycle which increased the amount of benzene recovered in the Warm Separator Bottoms Liquid 335, (2) simultaneously decreased the concentration of the benzene in the Warm Separator Bottoms Liquid 335, (3) decreased the amount and concentration of benzene in the Warm Separator Overhead Stream 308, (4) decreased the amount and concentration of benzene in the Cold Separator Bottoms Stream 326, (5) decreased the amount and concentration of benzene in the Cold Separator Overhead Stream 312, (6) decreased benzene in all points following the Cold Separator Overhead Stream 312, (7) increased the percent liquid in the Warm Separator inlet stream and in the Cold Separator inlet stream allowing better separation, and most importantly, (8) changed all locations in the process that had been freeze points using the First Embodiment to no longer being freeze points. Use of Cold Separator Bottoms Stream 326 for recycle also may assist start-up, as use of a new valve upstream of the Cold Separator 390 will allow pressure drop, auto refrigeration and creation of liquid without use of the downstream Expander. Higher liquid concentration in the separators will also allow operation at higher pressure without approaching critical points of the vapor/liquid mixtures feeding the separators. All C5+ components are affected by this new recycle in the same manner as benzene; more of all of these potential freeze components is removed in the Warm Separator Bottoms Liquid Stream 335, and the concentration is reduced at all points downstream in the process.

In summary, use of a portion of the low quality, benzene-contaminated, Cold Separator Bottoms Stream 326 as recycle results in an increase in removal of benzene upstream, which in turn increases the quality of the Cold Separator Bottoms Stream by reducing the concentration of all C5+ components.

Table 7 includes the flow rate and composition of the Cold Separator Bottoms Liquid Stream 326, for the first and second embodiments. The Second Embodiment recycles the majority of this stream; however, the net flow rate to Fractionation is unchanged. This demonstrates that the use of this stream as recycle is not subject to a maximum possible rate in the manner of the C3 and C4 recycle of the First Embodiment. The recycle of the Second Embodiment also does not affect the sizing of equipment in Fractionation Section 408, as the recycle of the First Embodiment did. The amount of light components to fractionation is decreased by use of Second Embodiment.

Table 8 also shows that use of the Second Embodiment recycle increases the percent liquid in streams entering the three separators shown, the Cold Separator in particular. The increase in liquid percent and liquid volume minimizes the risk of any carryover of liquid in the separator vapor streams, as each droplet also contains less of the C5+ freeze components in each of the separators.

Table 6 illustrates the change in approach to freeze temperatures with and without the recycle of the Second Embodiment. It is apparent that use of the Second Embodiment eliminates all freeze points present when the First Embodiment alone is utilized.

Table 8 also shows that Warm Separator, Cold Separator and Expander Separator operating temperatures and pressures are nearly unchanged from the First Embodiment to the Second Embodiment.

There are numerous variations in the practical implementation of the Second Embodiment, several non-limiting examples of which are briefly described below:

The Warm Separator 384 may be replaced with a multistage tower, with the Cold Separator Liquid Recycle Stream 408 as the top feed to the tower and the Warm Separator Feed Stream 406 routed as the bottom feed of the tower. The Cold Separator Liquid Recycle Stream 408 may be routed to the highest pressure separator of two or more Warm Separators connected and stacked so as to operate as a multistage tower, with the Warm Separator feed stream routed to the lowest pressure separator.

The Expander Outlet Separator 396 operating pressure may be increased to reduce gas recompression requirement, as long as the operating conditions result in an acceptable loss of C3 and C4 solvent in the vapor phase. The Warm Exchanger 382 and Warm Separator 384 pressure may be as high as is advantageous as long as the physical properties of the fluid allow for adequate separation of vapor and liquid in the warm separator. Increasing operating pressure may reduce recompression requirements.

The Cold Separator Liquid Recycle Stream 408 may be routed to high pressure Feed Gas in order to provide the physical properties of the mixed stream to be adequate to allow vapor/liquid separation in the Warm Separator 384. At times, use of the Cold Separator Liquid Recycle Stream 408 may allow operation of all separators at higher pressure than would be possible without the recycle, reducing overall operating power requirements by reducing pressure drop in the facility.

The Cold Separator Inlet Reduction Valve 412 may be used to reduce potential to freeze and increase flexibility of operations, especially during start-up. This valve may be used as a Joule-Thompson (JT) valve alone, or in conjunction with the Expander 394 or an expander bypass JT valve. In this manner, the initial start-up cool-down can include use of the Cold Separator 322 as the initial liquid formation point during cool-down, and the Cold Separator Liquid Recycle Stream 408 may be used to accelerate cooldown.

Separator liquid recycle may be cooled with an inlet gas flow in an exchanger, or as a separate stream and exchanger path. Separator recycle liquid may be introduced at an intermediate point in an exchanger.

Increasing minimum temperature achieved in an exchanger while cooling the feed gas may result in separator liquid recycle not being required in the exchanger pass. This can make recycle available for other locations.

The Second embodiment can increase removal of C5+ and BETX, including benzene, components in the warm section of the facility, and can minimize concentration of C5+ and benzene in the Cold Separator 390 and Expander Separator 396. Recycle may be applied at more than one location.

Two or more applications of the second embodiment may be sequential. In this manner, a portion of liquid from the Expander Separator 396 may be increased in pressure and recycled to the Cold Separator 390 or the upstream Cold Exchanger 388, and a portion of the liquid from the Cold Separator 390 may be increased in pressure and recycled to the Warm Separator 384 or the upstream Warm Exchanger 382.

Two of more applications of the embodiments may be nested. In this manner, a portion of the liquid from the Expander Separator 396 is increased in pressure and recycled to the Warm Separator 384 or Warm Exchanger 382, and a portion of the liquid from the Cold Separator 390 is also increased in pressure and recycled to the Warm Separator 384 or Warm Exchanger 382.

Lighter component streams, such as stream C1 and C2 Fractionation Stream 360 may be recycled to any point in the process upstream of the Expander Outlet Separator 396.

In all applications described above the liquid that is increased in pressure and recycled may be heated in the Warm Exchanger 382, the Cold Exchanger 388, or any other exchangers that are added to the system to provide efficient heat recovery.

Third Embodiment

A novel retrofit has been discovered for when the composition of feed gas to an existing high freeze point component removal facility changes to contain more benzene. Surprisingly, addition of a pump, or changing the routing of a stream, allows operation to continue with significantly higher inlet benzene content than in the original design, with minimal reduction in processing capacity.

In this embodiment, Example A is a Control, which shows a process that will work if the benzene concentration in the feed stream is relatively low. In Example A, the benzene concentration in the feed stream is 60 ppmv. Example B is a Control that shows the problems with the process and system of Example A when the feed has a higher benzene concentration. In Example B, the benzene concentration in the feed stream is 91 ppmv and the process is inoperable due to freezing of high freeze point hydrocarbons in the system. Example C shows the new embodiment, which is capable of being retrofitted into existing systems, and which can be used with high concentrations of benzene in the feed stream. The embodiment of Example C is versatile in that it also can be used with moderate or low benzene concentrations in the feed stream. In the version of Example C described herein, the benzene concentration in the feed stream is 91 ppmv and no freezing occurs in the system.

Figure 4:
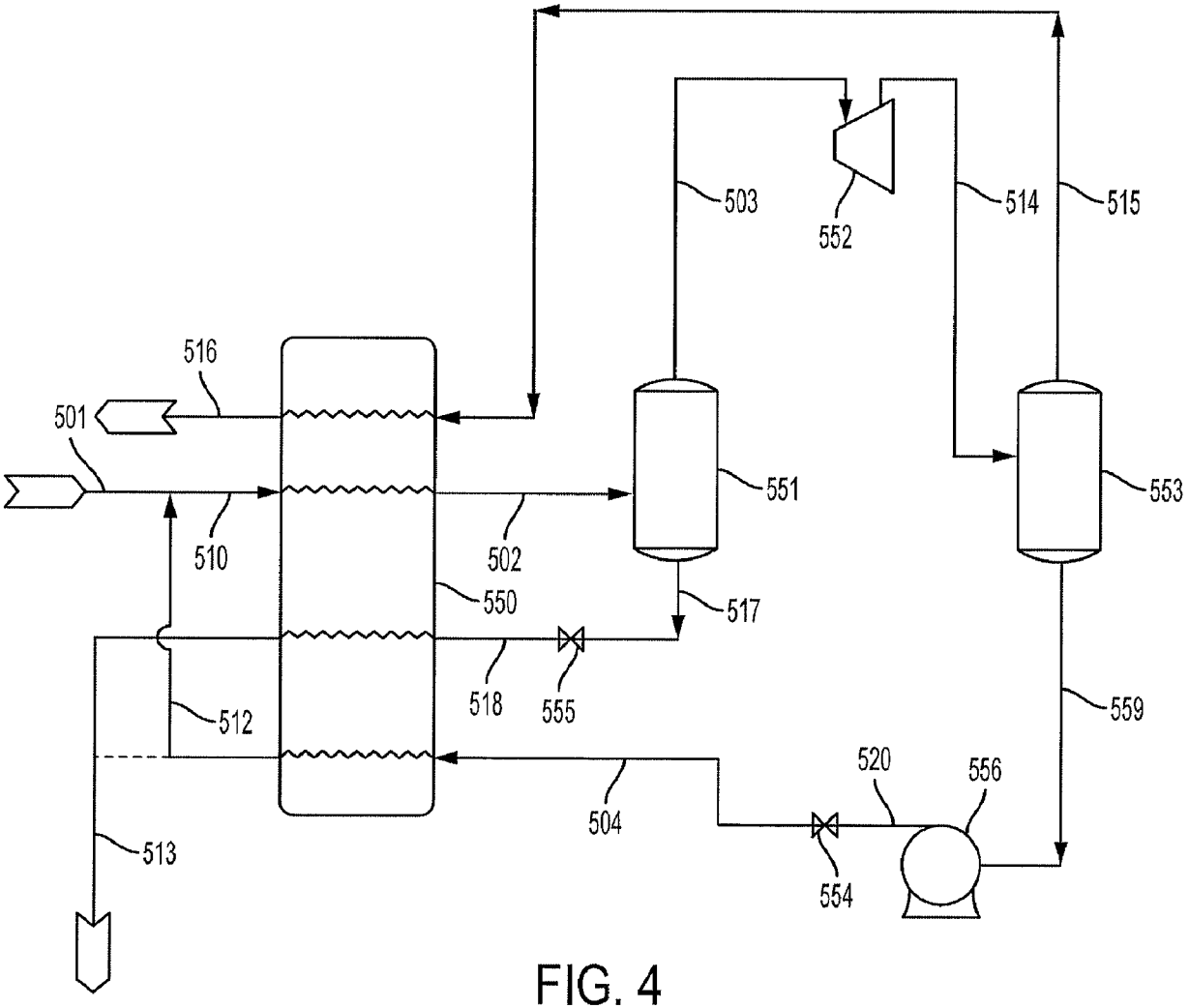
FIG. 4 schematically depicts a system and process for extracting high freeze point hydrocarbons from a gas stream in accordance with a third embodiment.

The Embodiment of Example C is shown in FIG. 4. To facilitate understanding of Control Example A and Control Example B, certain portions of FIG. 4 will be referred to in the descriptions of Control Examples A and B.

Example A—Control

Selected material streams are provided in Table 9. The approach to benzene freezing for select streams is also indicated in Table 9. In Example A, the benzene composition of the Feed Gas is 60 ppmv.

Referring to FIG. 4, feed Gas Stream 501 containing 60 ppmv benzene enters and is cooled in Exchanger 550, forming a partially condensed Stream 502, which enters First Separator 551. (There is no stream 512 in Example A.) Stream 503, which is the vapor from First Separator 551, enters a Pressure Reduction Device 552 (an expander or JT valve), which reduces the pressure of the feed gas and extracts energy from the stream. The reduced temperature Stream 514 which exits the Pressure Reduction Device 552 has been partially condensed, and is routed to a Second Separator 553. Vapor Stream 515 from Second Separator 553 is reheated in Exchanger 550 to provide cooling of Feed Gas Stream 501, and exits as Stream 516. In embodiments, Stream 516 is fed to a LNG liquefaction facility.

Stream 516 meets specifications for benzene and for C5+ hydrocarbons entering the liquefaction plant. Typical specifications are 1 ppmv benzene or less, and 0.05% molar C5+ or less.

Liquid Stream 517 from First Separator 551 is reduced in pressure across Level Control Valve 555, exiting as Stream 518. This partially vaporized and auto-refrigerating stream is reheated by exchange against the Feed Gas Stream 510 in Exchanger 550, leaving as Stream 513.

Liquid Stream 559 from Second Separator 553 is reduced in pressure across Level Control Valve 554, exiting as stream 504. In the Control Example A, there is no pump 556. This partially vaporized and auto-refrigerated stream is reheated by exchange against the Feed Gas Stream 510 in Exchanger 550 and is then combined with stream 518, leaving the process as part of Stream 513. Stream 513 contains the removed high freeze point hydrocarbons. Table 9 shows the process conditions and benzene concentrations of for Control Example A. The closest approach to freezing in Example A is 7 degrees F. in Stream 518. Table 10 shows an overall material balance for Control Example A, including the compositions of the feed and outlet streams. The compositions and process conditions for the separator bottoms streams are also shown. The purified gas stream 516 contains <1 ppm benzene and <0.05% C5+, meeting a typical purity specification for feed to an LNG facility.

TABLE 9

Select material balance streams for Control Example A, including amount of benzene in feed gas:

| PFD STREAM NO. | 501 | 502 | 503 | 514 | 515 | 516 | 517 |
|---|---|---|---|---|---|---|---|
| VAPOR FRACTION | 1.000 | 0.998 | 1.000 | 0.998 | 1.000 | 1.000 | 0.000 |
| TEMPERATURE F. | 57.1 | −80.0 | −80.2 | −107.8 | −108.0 | 35.3 | −80.1 |
| PRESSURE psia | 572.0 | 567.0 | 565.5 | 425.0 | 423.5 | 418.5 | 566.5 |
| LB-MOL/HR | 72,491 | 72,491.29 | 72,368.70 | 72,368.70 | 72,227.01 | 72,227.01 | 122.59 |
| COMPOSITION | | | | | | | |
| Benzene | 0.0060% | 0.0060% | 0.0009% | 0.0009% | 0.0000% | 0.0000% | 3.0604% |
| Benzene molar rate | 4.38 | 4.38 | 0.63 | 0.63 | 0.03 | 0.03 | 3.75 |
| Approach to Freeze | | | | | | | |

| PFD STREAM NO. | 518 | 519 | 559 | 504 | 512 | 513 |
|---|---|---|---|---|---|---|
| VAPOR FRACTION | 0.046 | 0.383 | 0.000 | 0.004 | 0.612 | 0.511 |
| TEMPERATURE F. | −84.0 | 50.0 | −107.8 | −108.3 | 50.0 | 50.3 |
| PRESSURE psia | 505.0 | 500.0 | 424.5 | 420.5 | 415.5 | 415.5 |
| LB-MOL/HR | 122.59 | 122.59 | 141.69 | 141.69 | 141.69 | 264.28 |
| COMPOSITION | | | | | | |
| Benzene | 3.0604% | 3.0604% | 0.4200% | 0.4200% | 0.4200% | 1.6448% |
| Benzene molar rate | 3.75 | 3.75 | 0.60 | 0.60 | 0.60 | 4.35 |
| Approach to Freeze | 7 | | | | | |

TABLE 10

Overall Material Balance for Example A

| STREAM NAME | | INLET | PURIFIED GAS | FIRST SEPARATOR LIQUID | SECOND SEPARATOR LIQUID | COMBINED RECOVERED LIQUID |
|---|---|---|---|---|---|---|
| PFD STREAM NO. | | 501 | 516 | 517 | 559 | 513 |
| VAPOR FRACTION | | 1.000 | 1.000 | 0.000 | 0.000 | 0.511 |
| TEMPERATURE | F. | 57.1 | 35.3 | −80.1 | −107.8 | 50.3 |
| PRESSURE | psia | 572.0 | 418.5 | 566.5 | 424.5 | 415.5 |
| MOLAR FLOW RATE | lbmole/hr | 72,491 | 72,227.01 | 122.59 | 141.69 | 264.28 |
| COMPOSITION | Mole % | | | | | |
| H2S | | 0.0000% | 0.0000% | 0.0000% | 0.0000% | 0.0000% |
| Oxygen | | 0.0000% | 0.0000% | 0.0000% | 0.0000% | 0.0000% |
| CO2 | | 0.0000% | 0.0000% | 0.0000% | 0.0000% | 0.0000% |
| Nitrogen | | 0.5105% | 0.5122% | 0.0472% | 0.0535% | 0.0506% |

TABLE 10-continued

| Overall Material Balance for Example A | | | | | | |
|---|---|---|---|---|---|---|
| STREAM NAME | | INLET | PURIFIED GAS | FIRST SEPARATOR LIQUID | SECOND SEPARATOR LIQUID | COMBINED RECOVERED LIQUID |
| Methane | | 97.6311% | 97.8082% | 44.3061% | 53.4669% | 49.2176% |
| Ethane | | 1.1247% | 1.3976% | 6.7601% | 10.6530% | 8.8472% |
| Propane | | 0.2487% | 0.2172% | 6.1756% | 11.1757% | 8.8564% |
| i-Butane | | 0.0493% | 0.0315% | 3.6275% | 6.0614% | 4.9324% |
| n-Butane | | 0.0574% | 0.0281% | 6.4791% | 9.4421% | 8.0677% |
| 22-Mpropane | | 0.0000% | 0.0000% | 0.0000% | 0.0000% | 0.0000% |
| i-Pentane | | 0.0211% | 0.0037% | 5.2604% | 4.4018% | 4.8001% |
| n-Pentane | | 0.0151% | 0.0014% | 4.7601% | 2.8796% | 3.7519% |
| n-Hexane | | 0.0141% | 0.0001% | 7.0003% | 1.1046% | 3.8395% |
| Benzene | | 0.0060% | 0.0000% | 3.0604% | 0.4200% | 1.6448% |
| n-Heptane | | 0.0143% | 0.0000% | 8.1005% | 0.3040% | 3.9204% |
| n-Octane | | 0.0070% | 0.0000% | 4.1257% | 0.0365% | 1.9333% |
| n-Nonane | | 0.0005% | 0.0000% | 0.2969% | 0.0007% | 0.1381% |
| THEOL-59 | | 0.0000% | 0.0000% | 0.0000% | 0.0000% | 0.0000% |
| H2O | | 0.0000% | 0.0000% | 0.0000% | 0.0000% | 0.0000% |
| Benzene | lbmole/hr | 4.38 | 0.03 | 3.75 | 0.60 | 4.35 |

Example B

For Example B the benzene composition of the Feed Gas is 91 ppmv. Other components are normalized to accommodate this benzene change. Conditions are provided in Table 11 and an overall material balance is shown in Table 12. Operating pressures are the same as in Example A The result is that the approach to freezing is now negative for some streams, with streams 514 and 518 now below the benzene freeze point in liquid. The freeze point of Stream 518 is inside of the expander near the inlet nozzle where the first liquid is formed. The plant as designed for Example A would freeze with the higher benzene content of Example B. Note also that the benzene concentration in stream 516, purified gas is higher than in Example A and is now 0.7 ppm (Table 11 Benzene rate divided by total rate).

TABLE 11

| Select material balance streams for example B, which has increased benzene in the feed gas: | | | | | | | |
|---|---|---|---|---|---|---|---|
| PFD STREAM NO. | | 501 | 502 | 503 | 514 | 515 | 516 |
| VAPOR FRACTION | | 1.000 | 0.998 | 1.000 | 0.998 | 1.000 | 1.000 |
| TEMPERATURE | F. | 57.1 | −80.0 | −80.2 | −107.8 | −108.0 | 35.3 |
| PRESSURE | psia | 572.0 | 567.0 | 565.5 | 425.0 | 423.5 | 418.5 |
| MOLAR FLOW RATE | lbmole/hr | 72491 | 72491 | 72363 | 72363 | 72224 | 72224 |
| COMPOSITON | Mole % | | | | | | |
| Benzene | | 0.01% | 0.01% | 0.00% | 0.00% | 0.00% | 0.00% |
| Benzene | lbmole/hr | 6.57 | 6.57 | 0.88 | 0.88 | 0.05 | 0.05 |
| Approach to Freeze, F. | | | | | −2 | | |

| PFD STREAM NO. | 517 | 518 | 519 | 559 | 504 | 512 | 513 |
|---|---|---|---|---|---|---|---|
| VAPOR FRACTION | 0.000 | 0.046 | 0.378 | 0.000 | 0.004 | 0.611 | 0.505 |
| TEMPERATURE | −80.1 | −83.9 | 50.0 | −107.8 | −108.3 | 50.0 | 50.3 |
| PRESSURE | 566.5 | 505.0 | 500.0 | 424.5 | 420.5 | 415.5 | 415.5 |
| MOLAR FLOW RATE | 128 | 128 | 128 | 139 | 139 | 139 | 267 |
| COMPOSITON | | | | | | | |
| Benzene | 4.45% | 4.45% | 4.45% | 0.60% | 0.60% | 0.60% | 2.44% |
| Benzene | 5.68 | 5.68 | 5.68 | 0.84 | 0.84 | 0.84 | 6.52 |
| Approach to Freeze, F. | | −2 | | | | | |

TABLE 12

| Overall Material Balance for Example B | | | | | | |
|---|---|---|---|---|---|---|
| STREAM NAME | | INLET | PURIFIED GAS | FIRST SEPARATOR LIQUID | SECOND SEPARATOR LIQUID | COMBINED RECOVERED LIQUID |
| PFD STREAM NO. | | 501 | 516 | 517 | 559 | 513 |
| VAPOR FRACTION | | 1.000 | 1.000 | 0.000 | 0.000 | 0.505 |
| TEMPERATURE | F. | 57.1 | 35.3 | −80.1 | −107.8 | 50.3 |

TABLE 12-continued

Overall Material Balance for Example B

| STREAM NAME | | INLET | PURIFIED GAS | FIRST SEPARATOR LIQUID | SECOND SEPARATOR LIQUID | COMBINED RECOVERED LIQUID |
|---|---|---|---|---|---|---|
| PRESSURE | psia | 572.0 | 418.5 | 566.5 | 424.5 | 415.5 |
| MOLAR FLOW RATE | lbmole/hr | 72,491 | 72,224.30 | 127.81 | 139.20 | 267.01 |
| COMPOSITION | Mole % | | | | | |
| H2S | | 0.0000% | 0.0000% | 0.0000% | 0.0000% | 0.0000% |
| Oxygen | | 0.0000% | 0.0000% | 0.0000% | 0.0000% | 0.0000% |
| CO2 | | 0.0000% | 0.0000% | 0.0000% | 0.0000% | 0.0000% |
| Nitrogen | | 0.5105% | 0.5122% | 0.0462% | 0.0533% | 0.0499% |
| Methane | | 97.6281% | 97.8086% | 43.8366% | 53.3626% | 48.8028% |
| Ethane | | 1.4247% | 1.3975% | 6.7505% | 10.6600% | 8.8778% |
| Propane | | 0.2487% | 0.2171% | 61669% | 11.1904% | 8.7858% |
| i-Butane | | 0.0493% | 0.0314% | 3.6258% | 6.0678% | 4.8989% |
| n-Butane | | 0.0574% | 0.0280% | 6.4737% | 9.4373% | 8.0187% |
| 22-Mpropane | | 0.0000% | 0.0000% | 0.0000% | 0.0000% | 0.0000% |
| i-Pentane | | 0.0211% | 0.0036% | 5.1913% | 4.3687% | 4.7624% |
| n-Pentane | | 0.0151% | 0.0014% | 4.6624% | 2.8519% | 3.7185% |
| n-Hexane | | 0.0141% | 0.0001% | 7.7674% | 1.0772% | 3.8009% |
| Benzene | | 0.0091% | 0.0001% | 4.4480% | 0.6018% | 2.4429% |
| n-Heptane | | 0.0143% | 0.0000% | 7.7873% | 0.2931% | 3.8803% |
| n-Octane | | 0.0070% | 0.0000% | 3.9592% | 0.0352% | 1.9135% |
| n-Nonane | | 0.0005% | 0.0000% | 0.2848% | 0.0006% | 0.1367% |
| THEOL-59 | | 0.0000% | 0.0000% | 0.0000% | 0.0000% | 0.0000% |
| H2O | | 0.0000% | 0.0000% | 0.0000% | 0.0000% | 0.0000% |
| Benzene | lbmole/hr | 6.57 | 0.05 | 5.68 | 0.84 | 6.52 |

Example C

This Example solves the problem presented in Example B. Referring to FIG. 4, this embodiment adds Pump 556 to the liquid outlet of Second Separator 553. Pump Outlet Stream 520 follows the path shown in FIG. 4, passing through valve 554 to become Stream 504 and passing through Exchanger 550. However, all or a portion of stream 504 does not join stream 518 to become stream 513, as in the prior examples. In this example, all of stream 512, containing the moles of benzene as per example B, is recycled back to join inlet stream 510, the inlet gas that required benzene to be removed from it.

Referring to FIG. 4, feed Gas Stream 501 containing 91 ppmv benzene enters and is cooled in Exchanger 550, forming a partially condensed Stream 502, which enters First Separator 551. Stream 503, which is the vapor from First Separator 551, enters a Pressure Reduction Device 552 (an expander or JT valve), which reduces the pressure of the feed gas and extracts energy from the stream. The reduced temperature Stream 514 which exits the Pressure Reduction Device 552 has been partially condensed, and is routed to a Second Separator 553. Vapor Stream 515 from Second Separator 553 is reheated in Exchanger 550 to provide cooling of Feed Gas Stream 501, and exits as Stream 516. In embodiments, Stream 516 is fed to a LNG liquefaction facility. Stream 516 meets specifications for benzene and for C5+ hydrocarbons entering the liquefaction plant.

Liquid Stream 517 from First Separator 551 is reduced in pressure across Level Control Valve 555, exiting as Stream 518. This partially vaporized and auto-refrigerating stream is reheated by exchange against the Feed Gas Stream 510 in Exchanger 550, leaving as Stream 513.

Liquid Stream 559 from Second Separator 553 is increased in pressure in pump 556, exiting the pump as stream 520. This stream passes through Level Control Valve 554, exiting as stream 504. This partially vaporized and auto-refrigerated stream is reheated by exchange against the Feed Gas Stream 510 in Exchanger 550 and is then recycled and mixed with feed gas stream 501 to form gas stream 510.

Stream 513 contains the removed high freeze point hydrocarbons. In certain embodiments, stream 504 can be divided and a first portion of stream 504 is recycled in stream 512, while a second portion is combined with stream 518 to form stream 513.

Table 13 shows selected streams for Example C, and the unexpected results of this new stream routing. By recycling the second separator liquid, what had in Example B been 13% of the inlet gas benzene and 24% of the inlet C5+ back to the inlet, the freezing is avoided. Although the recycled stream 512 contains significant freeze components, the recycle of the intermediate volatility components of ethane, propane and butane to the inlet has larger effect on the process than the recycled freeze components. The additional intermediate components allow a higher percent condensation of the stream 510 feed gas, causing the full requirement of benzene and C5+ removal to take place in the liquid outlet of the First Separator 551. The additional intermediate components also allow the freeze component removal to occur without freezing in the exchanger during cooling, or freezing in the pressure reduction across the level control valve 555. This occurs because the ratio of intermediate components to freeze components is higher in the second separator liquid than in the first separator liquid. Recycle of the intermediate components has a larger effect on freeze potential in the inlet exchanger and the first separator than the recycle of the freeze components. It is noted that the approach to freezing is now lower than in Control Example A, even with the much higher feed gas benzene content of Example C.

For Example C, the only addition made to the original process was addition of the pump and the inclusion of a recycle line for recycle stream 512. This is a very economical fix to a plant that could not otherwise operate. As is shown on Table 13, the closest approach to freeze is now 10 degrees F. in stream 18. Note that stream 518 had contained 5.68 lb-mol/hr of benzene in example B. With Example C, the lb-mols of benzene has increased in stream 518 to 6.55, but the concentration has decreased to 3.17% of the stream from 4.45% in example B. What had been a freeze point of −2 degrees F. is now 10 degrees F. above freezing. With all of the required benzene removal occurring at this point. The benzene concentration in stream 518 is now lower in Example C than it was in Example A, when the benzene concentration in the feed was ⅔rds of the benzene in Example C.

Example C confirms the feasibility and novelty of a process for the recovery of high freeze point components such as benzene from the feed gas to a liquefaction plant, said process consisting of one or more exchangers, at least one pressure reduction device, and two or more separators, wherein a portion of the liquid from a lower pressure separator is recycled to a higher pressure separator to prevent freezing.

TABLE 13

Select material balance streams for Example C

| PFD STREAM NO. | | 501 | 502 | 503 | 514 | 515 | 516 | 517 |
|---|---|---|---|---|---|---|---|---|
| VAPOR FRACTION | | 1.000 | 0.997 | 1.000 | 0.997 | 1.000 | 1.000 | 0.000 |
| TEMPERATURE | F. | 57.1 | −80.0 | −80.2 | −107.4 | −107.6 | 35.2 | −80.1 |
| PRESSURE | psia | 572.0 | 567.0 | 565.5 | 425.0 | 423.5 | 418.5 | 566.5 |
| MOLAR FLOW RATE | lbmole/hr | 72,491 | 72,721,47 | 72,514.79 | 72,514.79 | 72,284.62 | 72,284.62 | 206.69 |
| COMPOSITON | Mole % | | | | | | | |
| Benzene | | 0.0091% | 0.0100% | 0.0010% | 0.0010% | 0.0000% | 0.0000% | 3.1667% |
| Benzene | lbmole/hr | 6.57 | 7.24 | 0.70 | 0.70 | 0.02 | 0.02 | 6.55 |
| Approach to Freeze, ° F. | | | | | | | | |

| PFD STREAM NO. | 518 | 519 | 559 | 520 | 504 | 512 | 513 |
|---|---|---|---|---|---|---|---|
| VAPOR FRACTION | 0.047 | 0.404 | 0.000 | 0.000 | 0.000 | 0.548 | 0.404 |
| TEMPERATURE | −84.3 | 50.0 | −107.4 | −105.9 | −105.8 | 50.0 | 50.0 |
| PRESSURE | 505.0 | 500.0 | 424.5 | 600.0 | 596.0 | 591.0 | 500.0 |
| MOLAR FLOW RATE | 206.69 | 206.69 | 230.17 | 230.17 | 230.17 | 230.17 | 206.69 |
| COMPOSITON | | | | | | | |
| Benzene | 3.1667% | 3.1667% | 0.2923% | 0.2923% | 0.2923% | 0.2923% | 3.1667% |
| Benzene | 6.55 | 6.55 | 0.67 | 0.67 | 0.67 | 0.67 | 6.55 |
| Approach to Freeze, ° F. | 10 | | | | | | |

TABLE 14

| STREAM NAME | | INLET | PURIFIED GAS | FIRST SEPARATOR LIQUID | SECOND SEPARATOR LIQUID | COMBINED RECOVERED LIQUID |
|---|---|---|---|---|---|---|
| PFD STREAM NO. | | 501 | 516 | 517 | 559 | 513 |
| VAPOR FRACTION | | 1.000 | 1.000 | 0.000 | 0.000 | 0.404 |
| TEMPERATURE | F. | 57.1 | 35.2 | −80.1 | −107.4 | 50.0 |
| PRESSURE | psia | 572.0 | 418.5 | 566.5 | 424.5 | 40.0 |
| MOLAR FLOW RATE | lbmole/hr | 72,491 | 72,284.62 | 206.69 | 230.17 | 206.69 |
| COMPOSITION | Mole % | | | | | |
| H2S | | 0.0000% | 0.0000% | 0.0000% | 0.0000% | 0.0000% |
| Oxygen | | 0.0000% | 0.0000% | 0.0000% | 0.0000% | 0.0000% |
| CO2 | | 0.0000% | 0.0000% | 0.0000% | 0.0000% | 0.0000% |
| Nitrogen | | 0.5105% | 0.5118% | 0.0496% | 0.0546% | 0.0496% |
| Methane | | 97.6281% | 97.7774% | 45.4422% | 53.7449% | 45.4422% |
| Ethane | | 1.4247% | 1.4089% | 6.9483% | 10.6523% | 6.9483% |
| Propane | | 0.2487% | 0.2297% | 6.8775% | 11.6228% | 6.8775% |
| i-Butane | | 0.0493% | 0.0359% | 4.7516% | 6.7538% | 4.7516% |
| n-Butane | | 0.0574% | 0.0320% | 8.9477% | 10.4631% | 8.9477% |
| 22-Mpropane | | 0.0000% | 0.0000% | 0.0000% | 0.0000% | 0.0000% |
| i-Pentane | | 0.0211% | 0.0032% | 6.2972% | 3.7274% | 6.2972% |
| n-Pentane | | 0.0151% | 0.0011% | 4.9297% | 2.0425% | 4.9297% |
| n-Hexane | | 0.0141% | 0.0000% | 4.9272% | 0.5084% | 4.9272% |
| Benzene | | 0.0091% | 0.0000% | 3.1667% | 0.2923% | 3.1667% |
| n-Heptane | | 0.0143% | 0.0000% | 5.0138% | 0.1231% | 5.0138% |
| n-Octane | | 0.0070% | 0.0000% | 2.4719% | 0.0145% | 2.4719% |
| n-Nonane | | 0.0005% | 0.0000% | 0.1766% | 0.0003% | 0.1766% |
| Benzene | lbmole/hr | 6.57 | 0.02 | 6.55 | 0.67 | 6.55 |

In some cases the heat exchanger path used may not be rated for the pressure required of the pumped liquid to be able to recycle to the inlet gas. If this is the case, the pump is not installed, and the reheated and partially vaporized stream is separated in an additional vessel, and the liquid from the vessel pumped to inlet. The additional separator vapor may also be compressed to inlet if required to achieve the full possible result. Alternatively, a new exchanger for this path may be added as a separate component.

Example D

In another embodiment, if the inlet gas to the facility is compressed upstream of the freeze component removal facility, the pump is not required and the reheated vapor and liquid stream 512 may simply be let down to inlet compressor pressure for recycle with no additional equipment required for implementation other than the piping. External heat may be added if required to ensure vaporization into the feed gas.

Example E

In another embodiment, the liquid from any separator is recycled to any upstream separator in order to cause recovery of additional high freeze components earlier in the process and in the presence of additional liquid hydrocarbon, and in this manner avoid freezing at any point in the process.

Example F

In yet another embodiment, the process of FIG. 4 is unchanged. Stream 513, the recovered hydrocarbon stream comprising the removed high freeze point components and co-recovered lighter hydrocarbons may be separated into a stream of C5+ and benzene components and a stream of butane and lighter components. This may have already been accomplished in the original design of an existing facility that has been retrofitted in accordance with Example C. Whether the fractionation facility would be new or existing, recycle of the butane and lighter component stream to the plant inlet would cause additional liquid to form in the recovery plant and reduce the possibility of freezing.

All of the methods and apparatus disclosed herein can be made and executed without undue experimentation in light of the present disclosure. While the methods of this invention have been described in terms of illustrative embodiments, it will be apparent to those of skill in the art that variations may be applied to the methods and apparatus and in the steps or in the sequence of steps of the methods described herein without departing from the concept and scope of the invention. All such similar substitutes and modifications apparent to those skilled in the art are deemed to be within the scope and concept of the invention as defined by the appended claims.

What is claimed is:

1. A process for removing high freeze point hydrocarbons from a mixed feed gas stream having a methane content of at least 80% molar and comprising C2, C3, C4, C5, and C6+ hydrocarbons and benzene compounds, the process comprising:

cooling the mixed feed gas stream in an inlet heat exchanger to condense at least a portion of the C3, C4 and C5 hydrocarbons and high freeze point hydrocarbons, separating the condensed C3, C4, C5 hydrocarbons and high freeze point hydrocarbons in a warm separator to form a warm separator bottoms stream comprising at least a portion of the C3, C4, C5 hydrocarbons and high freeze point hydrocarbons and a warm separator overhead gas stream, cooling the warm separator overhead gas stream in a gas heat exchanger to condense at least a portion of the warm separator overhead gas stream, separating the condensed portion of the warm separator overhead gas stream in a cold separator to form; a cold separator overhead stream that is gaseous and methane-rich; and a cold separator bottoms stream comprising at least a portion of the C3, C4, C5 hydrocarbons and high freeze point hydrocarbons, combining the warm separator bottoms stream and the cold separator bottoms stream downstream of the warm separator to form a combined methane lean hydrocarbons stream;

feeding the combined methane lean hydrocarbons stream to a demethanizer column, and removing methane gas in a demethanizer overhead stream and removing a liquid stream as a demethanizer bottoms stream comprising at least a portion of the C3, C4, C5 hydrocarbons and high freeze point hydrocarbons, removing a methane-rich product gas stream downstream from the cold separator overhead stream of the cold separator, fractionating a portion of the demethanizer bottoms third liquid stream in a fractionation train to obtain a natural gas condensate stream and a recycle stream comprising at least one of: C3 hydrocarbons and C4 hydrocarbons, and feeding a portion of the recycle stream to the mixed feed gas stream upstream from the inlet heat exchanger to lower a freeze point of the mixed feed gas stream prior to entering the inlet heat exchanger and feeding an additional portion of the recycle stream to a location upstream from the demethanizer column to lower a freeze point of the stream at the location where the additional portion of the recycle stream is fed, wherein said high freeze point hydrocarbons have a freeze point of −150° F. or higher at 14.4 psia.

2. The process of claim 1, wherein the additional portion of the recycle stream is fed to the mixed feed gas stream downstream from the inlet heat exchanger and upstream from the warm separator.

3. The process of claim 1, wherein the additional portion of the recycle stream is fed to the warm separator bottoms stream.

4. The process of claim 1, wherein the additional portion of the recycle stream is fed to the cold separator bottoms stream.

5. The process of claim 1, wherein the additional portion of the recycle stream is fed to the warm separator overhead gas stream.

6. The process of claim 1, wherein the warm separator bottoms stream obtained from the warm separator contains C2+ hydrocarbons.

7. The process of claim 1, further comprising feeding the gaseous cold separator overhead stream from the cold separator to a demethanizer reflux accumulator downstream from the cold separator, wherein a demethanizer reflux accumulator bottoms stream from the demethanizer reflux accumulator is fed to the demethanizer column and the methane-rich product gas stream comprises at least a portion of a demethanizer reflux accumulator top stream from the demethanizer reflux accumulator.

8. The process of claim 7, wherein the additional portion of the recycle stream is fed to the demethanizer reflux accumulator bottoms stream from the demethanizer reflux accumulator.

9. The process of claim 7, wherein the cold separator overhead stream from the cold separator is expanded prior to being fed to the demethanizer reflux accumulator.

10. The process of claim 9, wherein the methane-rich product gas stream has a methane content of at least 85% molar methane.

11. The process of claim 1, further comprising mixing a portion of the methane-rich product gas stream with the mixed feed gas stream at a location upstream from the inlet heat exchanger during plant start-up.

12. The process of claim 1, further comprising using an expander to auto-refrigerate the cold separator overhead stream of the cold separator, wherein the auto-refrigerated gaseous methane-rich top stream is used to cool the mixed feed gas.

13. The process of claim 1, further comprising reheating a portion of the cold separator bottoms second liquid stream and recycling the reheated portion of the cold separator bottoms stream to at least one point upstream from the cold separator, wherein recycling the reheated portion of the cold separator bottoms stream increases the volume percent liquid in the stream entering the warm and cold separators and dilutes the concentration of high freeze point hydrocarbons in the liquid, thereby reducing the amount of high freeze point hydrocarbons that leave the separator with the overhead stream due to incomplete liquid recovery.

14. A system for removing high freeze point hydrocarbons from a mixed feed gas stream having a methane content of at least 80% molar, the system comprising:

an inlet heat exchanger for partially condensing the mixed feed gas;

a warm separator for separating the mixed feed gas to form a warm separator bottoms stream containing C3+ hydrocarbons and a warm separator overhead gas stream containing methane;

a gas heat exchanger for at least partially condensing the warm separator overhead gas stream;

a cold separator that receives a cold separator inlet stream comprising the warm separator overhead gas stream containing methane and that separates the cold separator inlet stream to form; a cold separator overhead stream that contains methane and is gaseous; and a cold separator bottoms stream that contains hydrocarbons and is liquid;

a line that feeds the warm separator bottoms stream to the cold separator bottoms stream downstream of the warm separator to form a combined methane lean hydrocarbons stream;

a demethanizer column that receives the combined methane lean hydrocarbons stream and that removes methane from the combined methane lean hydrocarbons stream;

a first solvent inlet that feeds a first portion of a solvent stream comprising at least one of C3 hydrocarbons and C4 hydrocarbons to the system, the first solvent inlet being positioned upstream from the inlet heat exchanger; and at least one additional solvent inlet that feeds a second portion of the solvent stream comprising at least one of C3 hydrocarbons and C4 hydrocarbons to the system, the at least one additional solvent inlet being positioned downstream from the inlet heat exchanger and upstream from the warm or cold separator, or downstream from the cold separator and upstream from the demethanizer column.

15. The system of claim 14, further comprising an expander positioned downstream from the cold separator, a demethanizer reflux accumulator positioned downstream from the expander and upstream from the demethanizer column, and a line that feeds a demethanizer reflux accumulator bottoms stream from the demethanizer reflux accumulator to the demethanizer column.

16. The system of claim 14, further comprising a line that feeds a portion of the cold separator bottoms stream to the mixed feed gas upstream from the inlet first heat exchanger.

* * * * *